US007244009B2

(12) United States Patent
Kobayashi et al.

(10) Patent No.: US 7,244,009 B2
(45) Date of Patent: Jul. 17, 2007

(54) INK JET TYPE RECORDING APPARATUS, INK TYPE INFORMATION SETTING METHOD IN THE APPARATUS AND INK CARTRIDGE USED IN THE APPARATUS

(75) Inventors: Atsushi Kobayashi, Nagano (JP); Toshio Kumagai, Nagano (JP); Shuichi Nakano, Nagano (JP); Daisuke Miyashita, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/023,036

(22) Filed: Dec. 28, 2004

(65) Prior Publication Data

US 2005/0110823 A1 May 26, 2005

Related U.S. Application Data

(62) Division of application No. 10/025,673, filed on Dec. 26, 2001, now Pat. No. 7,077,512.

(30) Foreign Application Priority Data

Dec. 26, 2000 (JP) ..... P2000-395733
Jan. 9, 2001 (JP) ..... P2001-001002

(51) Int. Cl.
*B41J 29/38* (2006.01)

(52) U.S. Cl. ..... 347/14; 347/19; 347/23

(58) Field of Classification Search ..... 347/56, 347/61–65, 67, 14, 19–20, 84–87, 5, 23
See application file for complete search history.

(56) References Cited

U.S. PATENT DOCUMENTS 5,506,611 A * 4/1996 Ujita et al. ..... 347/86
6,447,090 B1 9/2002 Saruta ..... 347/19
6,533,383 B1 3/2003 Saruta et al. ..... 347/19

FOREIGN PATENT DOCUMENTS

| | | |
|---|---|---|
| EP | 0 878 307 A2 | 11/1998 |
| EP | 0 960 736 A1 | 12/1999 |
| EP | 0960736 A1 | 12/1999 |
| EP | 1 004 447 A2 | 5/2000 |
| EP | 1 004 447 A3 | 5/2000 |
| EP | 1080917 A1 | 3/2001 |
| JP | H2-238952 | 9/1990 |

(Continued)

*Primary Examiner*—Juanita D. Stephens
(74) *Attorney, Agent, or Firm*—Sughrue Mion, PLLC

(57) ABSTRACT

Ink type information is read by a read and write system (62) from a semiconductor storage system mounted on ink cartridges (9*a* to 9*d*) attached to a cartridge holder (8). A decision control system (61) decides whether or not ink type information has already been stored in ink type storage system (63), and stores the ink type information thus read when the ink type information is not stored. In the case in which the ink cartridge is exchanged, the ink type information is similarly read and it is decided whether or not the same ink type information is identical to the ink type information stored in the ink type storage system (63). If they are not identical to each other, the operation of the recording apparatus is inhibited and a display system (68) is caused to display an error message thereon.

3 Claims, 17 Drawing Sheets

FOREIGN PATENT DOCUMENTS

| | | | |
|---|---|---|---|
| JP | 4-133746 | A | 5/1992 |
| JP | H6-155758 | | 6/1994 |
| JP | 6-262771 | A | 9/1994 |
| JP | 11-129498 | A | 5/1999 |
| JP | 2000-103087 | A | 4/2000 |
| JP | 2000-218825 | A | 8/2000 |
| JP | 2000-255052 | A | 9/2000 |
| JP | 2000-255079 | A | 9/2000 |
| JP | 2000-326501 | A | 11/2000 |
| JP | 2001-341322 | A | 12/2001 |

* cited by examiner

INK JET TYPE RECORDING APPARATUS, INK TYPE INFORMATION SETTING METHOD IN THE APPARATUS AND INK CARTRIDGE USED IN THE APPARATUS

CROSS-REFERENCE TO RELATED APPLICATIONS

This application is a divisional application of U.S. application Ser. No. 10/025,673, which was filed on Dec. 26, 2001, now U.S. Pat. No. 7,077,512.

BACKGROUND OF THE INVENTION

The present invention relates to an ink jet type recording apparatus to be set such that an ink type in an ink cartridge first attached to the recording apparatus can be used by the recording apparatus. The present invention also relates to a method of setting ink type information in the apparatus, and an ink cartridge capable of providing the ink type information to the apparatus.

Since an ink jet type recording apparatus can comparatively lessen a noise during printing and can form a small dot at a high density, it is used for many printing operations including color printing. In general, such an ink jet type recording apparatus comprises an ink jet type recording head which is mounted on a carriage and is moved in the transverse direction of a recording paper, and paper feeding means for relatively moving the recording paper in a direction orthogonal to the direction of the movement of the recording head. The recording apparatus serves to discharge ink droplets from the recording head based on print data, thereby carrying out printing record on the recording paper.

A recording head capable of discharging each of ink colors, for example, black, yellow, cyan and magenta is mounted on a carriage to execute not only text printing using black ink but also full color printing by changing the discharge rate of each ink color.

In many recording apparatuses under the present circumstances, dye ink is used. In recent years, however, printing has been very diversified and pigment dispersion group ink (hereinafter referred to as pigment ink) tends to be used. In some cases, moreover, the same recording apparatus can be used by properly carrying out a method of controlling the apparatus. However, the dye ink and the pigment ink have different properties. Therefore, in the case in which they are mixed, the ink physical properties are changed so that the reliability of printing might be deteriorated. In the worst case, furthermore, the ink is caked or solidified by the mixture. Therefore, there is also a problem in that serious defects might be caused on the recording apparatus.

In the recording apparatus of this kind, it is necessary to avoid the alternate use of the dye ink and the pigment ink. Therefore, it is desirable that the recording apparatus should manage ink cartridges during ink cartridge exchange operation such that a cartridge for the dye ink is to be used in a recording apparatus first using the dye ink, and a cartridge for the pigment ink is to be used in a recording apparatus first using the pigment ink.

SUMMARY OF THE INVENTION

The invention has been made to solve the technological problems described above and has an object to provide an ink jet type recording apparatus that can set a specific ink type to be used by the recording apparatus automatically. The invention is also purposed to provide a method of setting ink type information in the apparatus. Further, the invention has an object to provide an ink cartridge capable of giving information about the use of a specific ink type to the setting system of the recording apparatus.

In order to attain the object, the invention provides an ink jet type recording apparatus comprising a cartridge holder capable of removably attaching an ink cartridge and a recording head for receiving supply of an ink from the ink cartridge attached to the cartridge holder and discharging an ink drop based on print control data, thereby printing an image on a recording medium, wherein in the case in which the ink cartridge is attached to the cartridge holder, it is decided whether or not ink type information to be used in the recording apparatus is set, and an operation for setting ink type information which can use an ink type accommodated in the attached ink cartridge is carried out if it is decided that the ink type information is not set.

In this case, it is desirable that the ink cartridge to be used in the recording apparatus should include an identifying system for indicating an accommodated ink type and the recording apparatus receiving attachment of the cartridge should comprise an information obtaining system capable of obtaining ink type information from the identifying system.

In this case, furthermore, it is desirable that the ink cartridge should include a semiconductor storage system storing information indicative of an ink type as the identifying system and the recording apparatus receiving the attachment of the cartridge should comprise, as the information obtaining system, an information reading system capable of reading the ink type information from the semiconductor storage system.

It is desirable that there should further be provided a matching deciding system for deciding a matching of set ink type information and ink type information obtained from a newly attached ink cartridge based thereon in the case in which the ink type information is set to the recording apparatus by the operation for setting the ink type information, an operation of the recording apparatus being capable of being inhibited if the matching deciding system decides that there is no matching. In this case, moreover, an alarm may be given.

It is preferable that an operation sequence of the recording apparatus corresponding to ink type information should be set with the operation for setting the ink type information. Moreover, it is preferable that a driving condition of a recording head corresponding to ink type information should be set with the operation for setting the ink type information. Furthermore, it is preferable that an image processing method corresponding to ink type information should be set with the operation for setting the ink type information.

On the other hand, in the recording apparatus having the structure described above, it is desirable that the operation for setting ink type information should be carried out only when the recoding apparatus obtains ink type setting permission information for permitting an operation for setting an ink type through the ink cartridge attached to the recording apparatus.

In this case, it is preferable that the ink type setting permission information should be stored in the semiconductor storage system mounted on the ink cartridge, and an operation for disabling to reread the ink type setting permission information in the semiconductor storage system in response to a command sent from the recording apparatus or erasing the ink type setting permission information should be carried out after the recording apparatus reads the ink type setting permission information.

Moreover, the invention provides a method of setting ink type information in an ink jet type recording apparatus comprising a cartridge holder capable of removably attaching an ink cartridge and a recording head for receiving supply of ink from the ink cartridge attached to the cartridge holder and discharging an ink droplets based on print control data, thereby printing an image on a recording medium, comprising an ink type information obtaining step of obtaining ink type information from each ink cartridge attached to the cartridge holder, an ink type information comparing step of deciding whether or not all the ink type information obtained at the ink type information acquiring step are identical, a setting ascertaining step of ascertaining whether or not ink type information about an ink to be used in the recording apparatus has already been set, and an ink type information setting step of carrying out setting such that an ink corresponding to the obtained ink type information can be used in the recording apparatus if it is decided that the ink type information is not set at the setting ascertaining step and it is decided that all the ink type information sent from the ink cartridges are identical at the ink type information comparing step.

In this case, it is preferable that an attachment state deciding step of deciding whether or not all the ink cartridges are attached to the cartridge holder should be executed before execution of the ink type information obtaining step, and the ink type information acquiring step should be executed if it is decided that all the ink cartridges are attached at the attachment state deciding step.

More preferably, the ink type information setting step is executed only when it is decided that the ink type is not set at the setting ascertaining step and ink type setting permission information is obtained from the attached ink cartridge.

According to the ink jet type recording apparatus employing the method of setting ink type information, in the case in which the ink cartridge is attached to the cartridge holder, the ink type information is obtained by utilizing the identifying system indicative of an ink type which is provided in the ink cartridge. On the other hand, it is decided whether or not the information about the ink type to be used in the recording apparatus has already been set in the recording apparatus. If it is decided that the ink type information is not set, the operation for setting the ink type information provided from the cartridge is executed. In the recording apparatus provided as a bland new product, accordingly, the ink type information corresponding to ink to be first used is automatically set to the recording apparatus.

The identifying system indicative of an ink type which is provided in the ink cartridge may arrange a plurality of recessed and protruded portions in a part of the shell case of the cartridge, for example, and may obtain information indicative of an ink type in the recording apparatus based on an arrangement configuration thereof, and furthermore, may arrange a bar code in the predetermined portions of the shell case of the cartridge to read the bar code in the recording apparatus and to obtain information indicative of the ink type. Moreover, it is desirable that the semiconductor storage system such as an EEPROM should be employed for the identifying system indicative of the ink type which is provided in the cartridge and the ink type information can be read from the semiconductor storage system in a state of attachment to the recording apparatus.

On the other hand, in the recording apparatus, it is possible to decide a matching of set ink type information and ink type information obtained from a newly attached ink cartridge based thereon after the operation for setting ink type information is carried out. In the case in which it is decided that they have no matching, the operation of the recording apparatus is inhibited. Moreover, it is possible to prevent the ink having no matching from being mixed in the recording apparatus by taking a countermeasure, for example, inhibiting the operation of the recording apparatus or giving an alarm.

In addition, the ink cartridge comprises the ink type setting permission information and management is carried out such that the operation for setting ink type information is executed only in the case in which the recording apparatus obtains the ink type setting permission information. Only in the case in which a specific ink cartridge is attached, consequently, the operation for setting ink type information is carried out.

In other words, even if an ink cartridge having no ink type setting permission information and put on the market, for example, is first attached to the recording apparatus, the operation for setting ink type information cannot be carried out. By managing the ink type setting permission information, thus, it is possible to prevent the operation for setting ink type information from being carried out erroneously for the recording apparatus.

Furthermore, the ink type setting permission information is stored in the semiconductor storage system mounted on the ink cartridge such that the ink type setting permission information in the semiconductor storage system cannot be reread in response to an instruction sent from the recording apparatus or an operation for erasing the ink type setting permission information is carried out. Consequently, it is possible to eliminate the function of setting the ink type information to other unused kinds again. Thus, it is possible to prevent the operation for setting ink type information from being carried out erroneously for other unused kinds.

On the other hand, the invention provides an ink cartridge holding at least ink type information indicative of an ink type of an accumulated ink and ink type setting permission information for permitting a recording apparatus to set an ink type by utilizing the ink type information, wherein the ink type information and the ink type setting permission information are provided to the recording apparatus in a state of attachment to the recording apparatus, and an ink type to be used in the recording apparatus can be set on a condition that the ink type setting permission information is acquired in the recording apparatus.

In this case, it is desirable that the ink type information and the ink type setting permission information should be stored in semiconductor storage means mounted on the ink cartridge, and the ink type information and the ink type setting permission information can be provided to the recording apparatus in a state of attachment to the recording apparatus.

Furthermore, it is preferable that the ink type setting permission information stored in the semiconductor storage system can bring a state in which the ink type setting permission information cannot be reread or the ink type setting permission information can be erased upon receipt of a command from the recording apparatus.

In addition, it is desirable that the ink cartridge including the ink type setting permission information should have such a configuration as to be packed and shipped together with the recording apparatus.

According to the ink cartridge having such a configuration, the original functions and effects described above can be produced by utilizing the ink cartridge for the recording apparatus. Management can be carried out such that the operation for setting ink type information can be executed in the recording apparatus only in the case in which an ink cartridge packed and shipped together with the recording apparatus is attached.

The present disclosure relates to the subject matter contained in Japanese patent application Nos. 2000-395733 (filed on Dec. 26, 2000), and 2001-001002 (filed on Jan. 9, 2001), which are expressly incorporated herein by reference in their entireties.

DESCRIPTION OF THE PREFERRED EMBODIMENT

Figure 1:
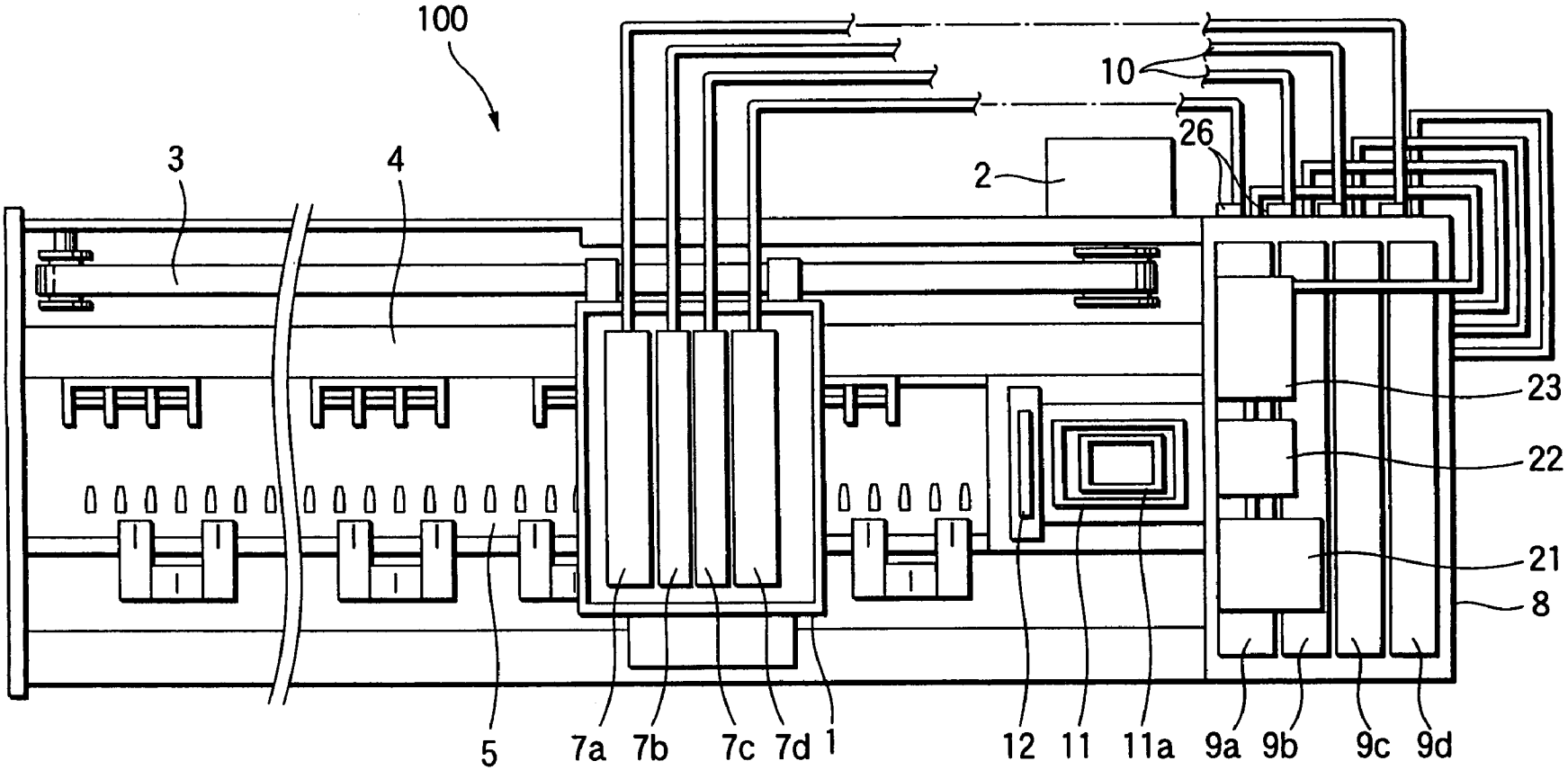
FIG. 1 is a plan view showing the whole structure of an ink jet type recording apparatus to which the invention is applied.

An ink jet type recording apparatus employing a method of setting ink type information and an ink cartridge to be used therein according to the invention will be described below based on a preferred embodiment shown in the drawings. First of all, FIG. 1 is a top view showing the whole structure of the ink jet type recording apparatus 100. In FIG. 1, the reference numeral 1 denotes a carriage. The carriage 1 is constituted to be guided along a scanning guide member 4, and reciprocated in a longitudinal direction of a paper feeding member 5, that is, a main scanning direction to be a lateral direction of a recording paper through a timing belt 3 driven by a carriage motor 2. An ink jet type recording head 6 which will be described below is mounted on an opposed surface, to the paper feeding member 5, of the carriage 1, which is not shown in FIG. 1.

Moreover, subtanks 7*a* to 7*d* for supplying ink to the recording head are mounted on the carriage 1. In the embodiment, four subtanks 7*a* to 7*d* are provided corresponding to respective ink colors (for example, black, yellow, cyan and magenta) in order to temporarily store each ink therein.

The black ink and each color ink are supplied from ink cartridges (herein after referred to as main tanks) 9*a* to 9*d* attached to a cartridge holder 8 provided on the body or frame of the recording apparatus to the subtanks 7*a* to 7*d* through flexible ink supply tubes 10, 10, . . . constituting an ink supply path, respectively.

On the other hand, a capping system 11 capable of sealing a nozzle formation surface of the recording head is provided in a non-print region (a home position) on a moving path for the carriage 1, and furthermore, an upper surface of the capping system 11 is provided with a cap member 11*a* formed of an elastic material such as rubber which can seal the nozzle formation surface of the recording head inclose contact there with. When the carriage 1 is moved to the home position, the capping system 11 can be moved toward the recording head side to seal the nozzle formation surface of the recording head by means of the cap member 11*a*.

The cap member 11*a* functions as a 11*d* member for sealing the nozzle formation surface of the recording head for a period in which the recording apparatus stops working, and for preventing nozzle openings from being dried. Moreover, one of ends of a tube in a sucking pump (a tube pump) which will be described below is connected to the cap member 11*a*, and the cap member 11*a* also fulfils the function of executing a cleaning operation for applying a negative pressure to the recording head with the sucking pump, thereby sucking and discharging ink from the recording head.

On the other hand, a wiping member 12 formed of an elastic material such as rubber like a strap is provided adjacently to the print region side of the capping system 11 such that the nozzle formation surface of the recording head can be swept out and cleaned if necessary.

Figure 2:
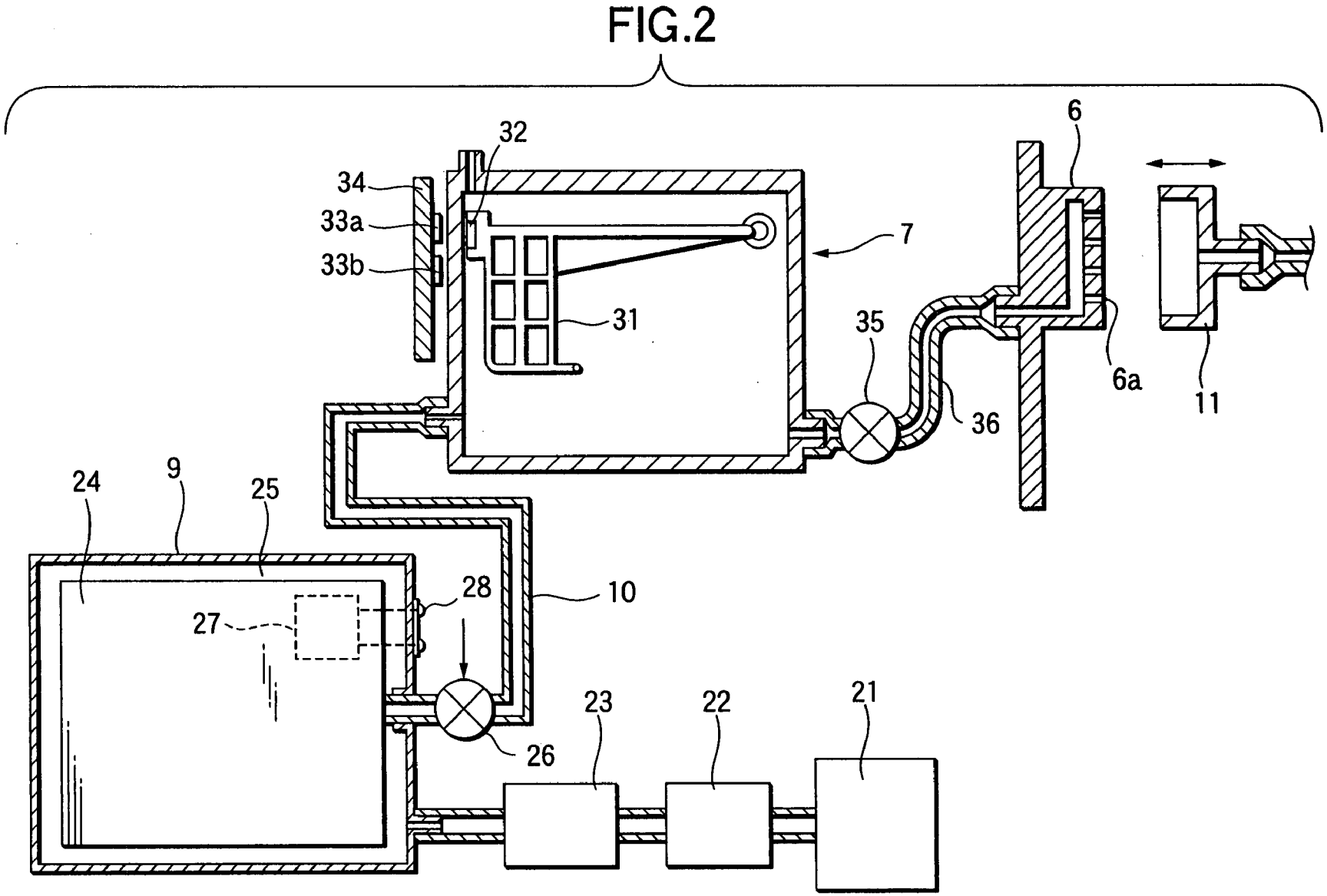
FIG. 2 is a typical view showing an ink supply system extending from a main tank to a recording head.

FIG. 2 schematically shows the structure of an ink supply system mounted on the recording apparatus illustrated in FIG. 1. The ink supply system will be described with reference to FIGS. 1 and 2 having the same reference numerals. In FIGS. 1 and 2, the reference numeral 21 denotes an air pressurizing pump. The air pressurized by the air pressurizing pump 21 is supplied to a pressure regulating valve 22, and furthermore, to the main tanks 9*a* to 9*d* through a pressure detector 23 respectively (The main tanks 9*a* to 9*d* are typically indicated as 9 in FIG. 2 and will be simply described below by using the reference numeral 9 in some cases.).

In this case, an air passage branches off from the pressure detector 23 to each main tank 9, and the pressurized air is applied to each main tank attached to the cartridge holder 8. The pressure regulating valve 22 has the function of releasing a pressure to maintain an air pressure applied to the main tanks 9*a* to 9*d* within a predetermined range when the air pressure increased by the air pressurizing pump 21 reaches an excessive state due to some trouble.

Furthermore, the pressure detector 23 functions to detect an air pressure increased by the air pressurizing pump 21 and to control the driving operation of the air pressurizing pump 21. More specifically, in the case in which the pressure detector 23 detects that the air pressure increased by the air pressurizing pump 21 reaches a predetermined pressure, it stops the driving operation of the air pressurizing pump 21 based thereon. In the case in which the pressure detector 23 detects that the air pressure is reduced to a predetermined pressure or less, it controls the air pressurizing pump 21 to be driven. By such repetition, thus, the pressure detector 23 functions to maintain the air pressure to be applied to the main tanks 9*a* to 9*d* within a predetermined range.

As shown in FIG. 2 illustrating the schematic structure of the main tank 9, a case constituting a shell thereof is formed in an airtightness state, and an ink pack 24 containing ink, which is formed of a flexible material, is accommodated in the case. A space formed by the main tank 9 and the ink pack 24 constitutes a pressure chamber 25, and the pressurized air is supplied into the pressure chamber 25 through the pressure detector 23.

By such a structure, each ink pack 24 accommodated in each of the main tanks 9*a* to 9*d* is pressurized by the pressurized air such that an ink flow is generated by a predetermined pressure from each of the main tanks 9*a* to 9*d* to each of the subtanks 7*a* to 7*d*.

As shown in FIG. 2, a semiconductor storage system 27, such as an EEPROM, is mounted on a part of the case in the main tank 9, i.e. the ink cartridge. In this embodiment, the semiconductor storage system 27 stores at least information indicative of a type of ink accumulated in the ink cartridge (for example, ink type information indicative of dye ink or pigment ink) and ink type setting permission information for permitting a recording apparatus to execute an operation for setting an ink type. As shown in FIG. 2, terminals 28 capable of reading or writing information from or to the semiconductor storage system 27 is provided in a part of the main tank 9, and can be electrically connected to the recording apparatus side when the main tank 9 is attached to the recording apparatus.

On the other hand, the ink pressurized in each of the main tanks 9*a* to 9*d* is supplied to a corresponding one of the subtanks 7*a* to 7*d* mounted on the carriage 1 through a corresponding one of ink supply valves 26, 26, . . . and a corresponding one of the ink supply tubes 10, 10, . . . , respectively (The subtanks 7*a* to 7*d* are typically indicated as 7 in FIG. 2 and will be simply described below by using the reference numeral 7 in some cases.)

In the basic structure of the subtank 7, a float member 31 is provided therein and a permanent magnet 32 is attached to a part of the float member 31. Magneto-electric converting elements 33*a* and 33*b* represented by hole elements are attached to a board 34 and are attached to a side wall of the subtank 7.

By such a structure, there is constituted, in cooperation with the permanent magnet 32 provided on the float member 31, an output generating system for generating an electric output through the hole elements 33*a* and 33*b* depending on a line of magnetic force by the permanent magnet 32 in accordance with a floating position of the float member. Thus, an ink amount detecting system in the subtank is constituted including the float member 31.

In the embodiment, the ink amount detecting system is utilized for detecting that the amount of the ink in the subtank reaches a predetermined capacity (an ink full state) when the ink is supplied from the main tank 9 to the subtank 7. In this case, the ink supply valve 26 is closed based on the electric outputs of the hole elements 33*a* and 33*b*.

Moreover, in the case in which it is found from the electric outputs of the hole elements 33*a* and 33*b* that the amount of the ink in the subtank reaches a predetermined capacity or less (an ink low state) by the execution of a print operation, the ink supply valve 26 is opened. Consequently, the ink pressurized in the main tank 9 is individually supplied into the respective subtanks 7 which have greatly consumed the ink. By repetition of these operations, the ink is intermittently supplied from the main tank to the subtank, and the ink within a constant range is always accumulated in each subtank.

Moreover, the ink is supplied from each subtank 7 to the recording head 6 through a corresponding valve 35 and a corresponding tube 36 connected thereto as shown in FIG. 2, and ink droplets are discharged from nozzle openings 6*a* formed on the nozzle formation surface of the recording head 6 based on print data fed to an actuator of the recording head 6 which is not shown. In FIG. 2, the reference numeral 11 denotes the capping system and a tube connected to the capping system 11 is connected to a sucking pump (a tube pump) which will be described later.

Figure 3:
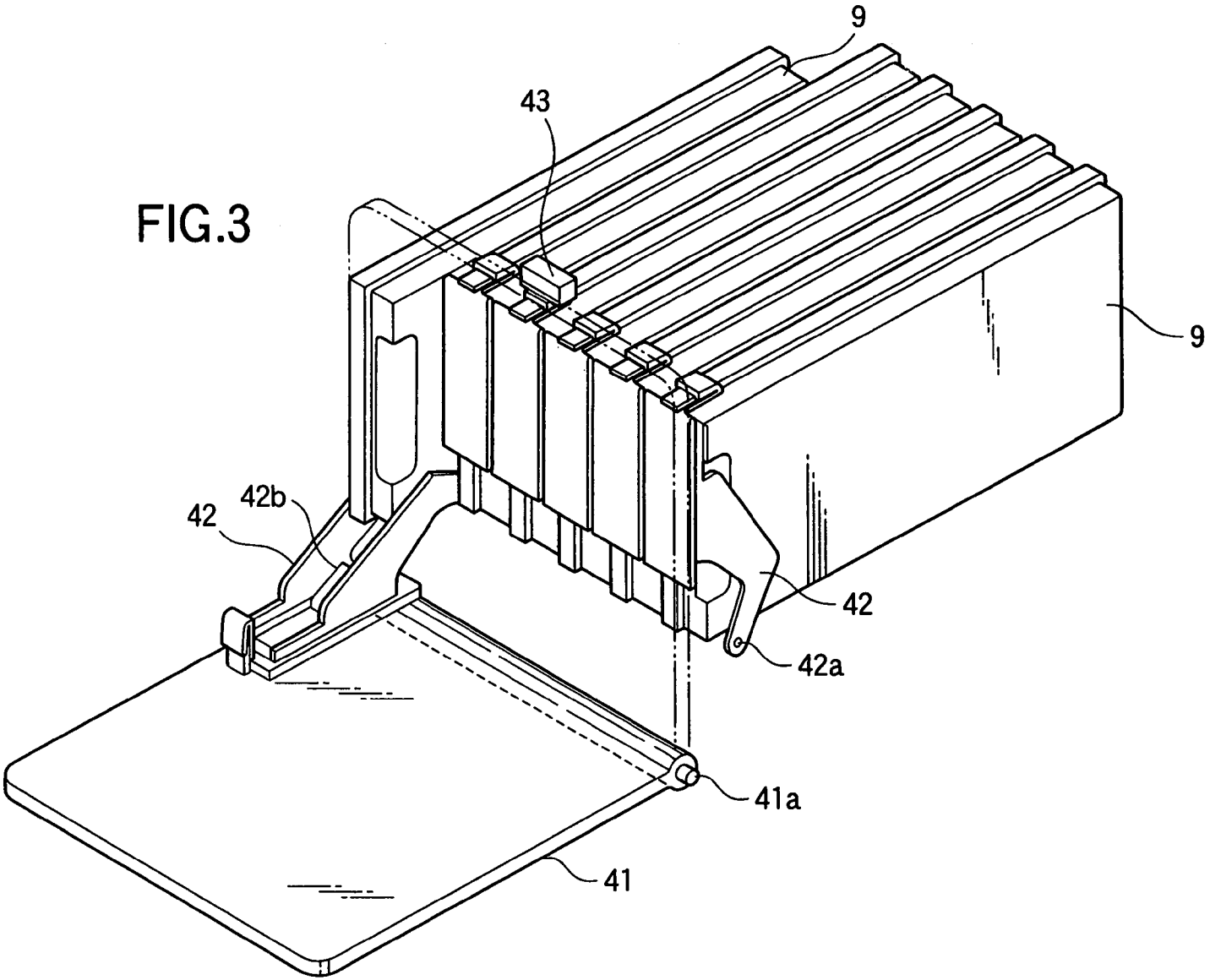
FIG. 3 is a perspective view showing the structure of the front surface side of a cartridge holder.

FIG. 3 shows the structure of the front surface side of the cartridge holder 8. This cartridge holder 8 shown in FIG. 3 is designed to hold six ink cartridges therein, whereas the ink cartridge holder 8 shown in FIG. 1 is designed to hold four ink cartridges, however, since the structure of these ink cartridge holders shown in FIGS. 1 and 3 is basically the same, the description will be given of the holder 8 shown in FIG. 1 with reference to FIG. 3. The cartridge holder 8 is provided with a cover member 41 to be opened when the main tank is attached and removed. More specifically, the cover member 41 is provided on a front surface of an opening of the cartridge holder 8, and a rotating shaft 41*a* is supported in support holes formed on the recording apparatus body which is not shown. The front surface of the opening of the cartridge holder 8 can be opened (a state shown in a solid line) or blocked (a state shown in a dotted line) by rotating the cover member 41 about the shaft 41*a*.

A plurality of operation levers 42 are provided corresponding to respective main tanks 9 attached to the cartridge holder 8 on the inside in which the cover member 41 is set in the blocking state. Engagement holes 42*a* are formed on base ends of the operation lever 42. A support rod, which is not shown, is passed through the engagement holes 42*a* of the operation levers 42 to rotatably support the operation levers 42.

In a state in which the cover member 41 remains opened, when the operation lever 42 is rotated in the same direction as a direction of opening of the cover member 41, the corresponding main tank 9 can be attached or removed. More specifically, in the case in which the main tank 9 is to be attached to the cartridge holder 8, the main tank 9 is inserted into the cartridge holder 8 after the operation lever 42 is rotated in the same direction as the direction of the opening of the cover member 41, and then the operation lever 42 is erected. Consequently, a pushing section 42*b* formed on the operation lever 42 abuts on a front end of the main tank 9 to attach the main tank 9 to the holder 8 by the action of the lever principle.

In the case in which the main tank 9 attached to the holder 8 is to be pulled out, the operation lever 42 is similarly rotated in the same direction as the direction of the opening of the cover member 41 to push out the main tank 9 from the inner side through a link rod engaged with a part of the operation lever 42, which is not shown. Accordingly, the main tank 9 pushed out in the direction toward the front side can easily be pulled out.

The cartridge holder 8 is further provided with an electric switch 43 for detecting the opening of the cover member 41. For the switch 43, there is used, for example, a tact switch which is turned ON in contact with a back surface of the cover member 41 in a state in which the cover member 41 is closed, and is turned OFF in a state in which the cover member 41 is opened. The switch 43 forcibly opens the pressure regulating valve 22 in the OFF state. Consequently, when the cover member 41 is opened in a work for exchanging an ink cartridge or ink cartridges, the pressurized air given to the ink cartridges is released to the atmosphere.

Figure 4:
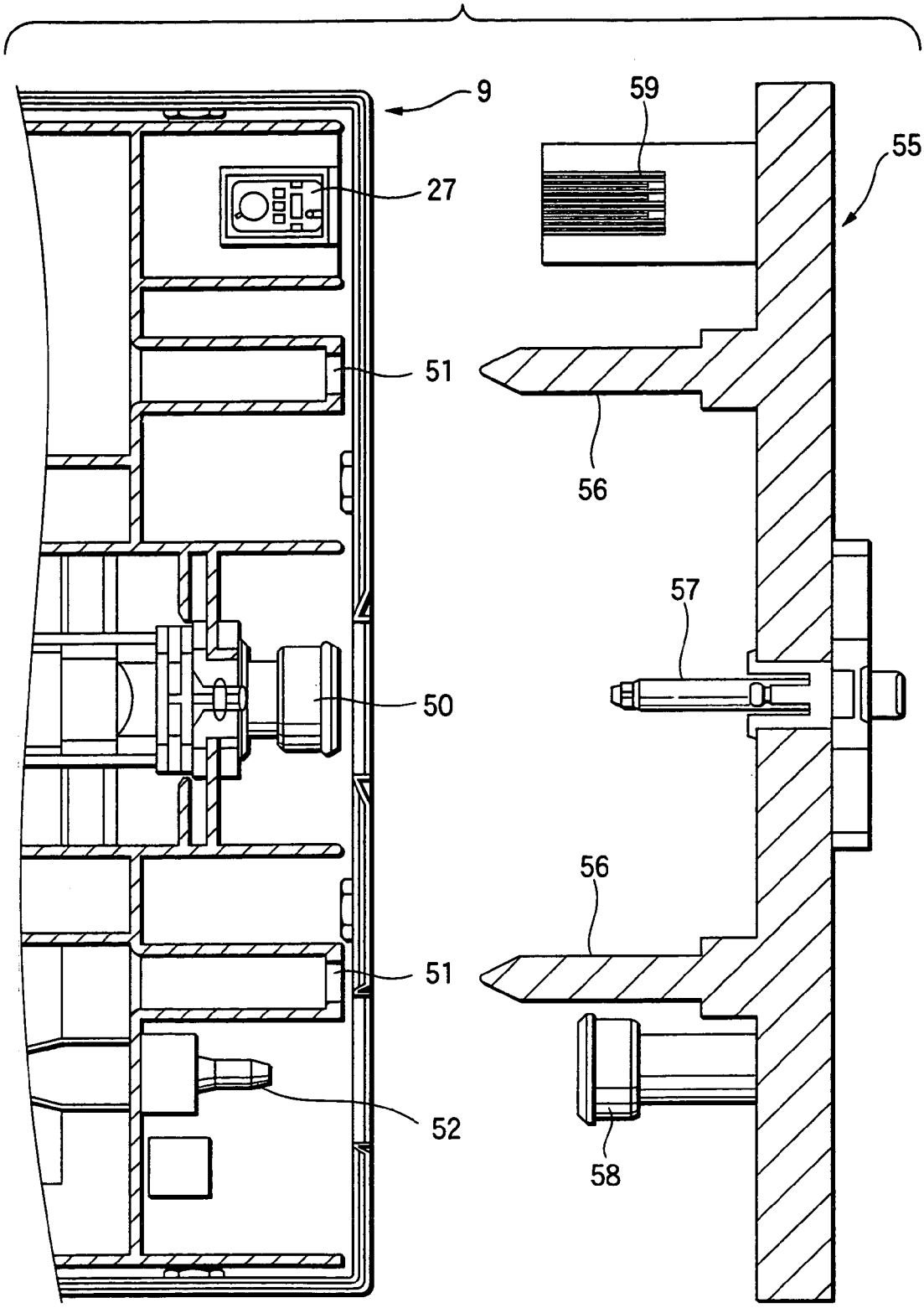
FIG. 4 is a sectional view showing the structures of the respective opposed portions of a connecting mechanism provided in the cartridge holder and a part of an ink cartridge.

FIG. 4 is a sectional view showing the structure of a connecting mechanism provided in the cartridge holder 8 and the structure of an end of the main tank 9, i.e. the ink cartridge. The main tank 9 serving as the ink cartridge is provided with a pair of openings 51 to serve a positioning system, which are utilized for attachment to the recording apparatus. Moreover, an ink outlet section 50 for leading ink from the ink pack 24 is attached to an almost middle portion between the positioning openings 51. An inlet port 52 for the pressurized air and a circuit board 27 comprising the semiconductor storage system, from or to which information about the ink cartridge can be read or written, are provided on both outsides of the openings 51 formed in the two portions, respectively.

On the other hand, a pair of positioning pins 56 formed cylindrically are provided in the connecting mechanism 55 disposed on the cartridge holder 8, and the positioning openings 51 formed on the main tank 9 are attached to surround respective positioning pin 56.

Thus, the positioning openings 51 are provided in the two portions of the case on the main tank 9. Therefore, the two positioning pins 56 provided on the recording apparatus side are attached to base ends of the positioning pins 51 so that the main tank 9, serving as the cartridge, can be positioned in a three-dimensional manner. The main tank 9 is attached with respect to the positioning pins 56, so that a hollow ink inlet tube 57 provided in an almost middle portion between the positioning pins 56 is inserted into the ink outlet section 50 extending from the ink pack 24. Thus, the ink can be led from the cartridge.

By the attachment of the main tank 9, moreover, the inlet port 52 for the pressurized air is connected to a feeding port 58 for the pressurized air which is provided on the cartridge holder 8 so that the pressurized air can be introduced into the main tank 9. Furthermore, a terminal mechanism 59 comprising a plurality of contact pieces is connected to the circuit board 27 provided on the main tank 9 so that the recording apparatus can transfer data between the semiconductor storage system provided in the circuit board 27 and a printer memory 80 provided in the recording apparatus.

Figure 5:
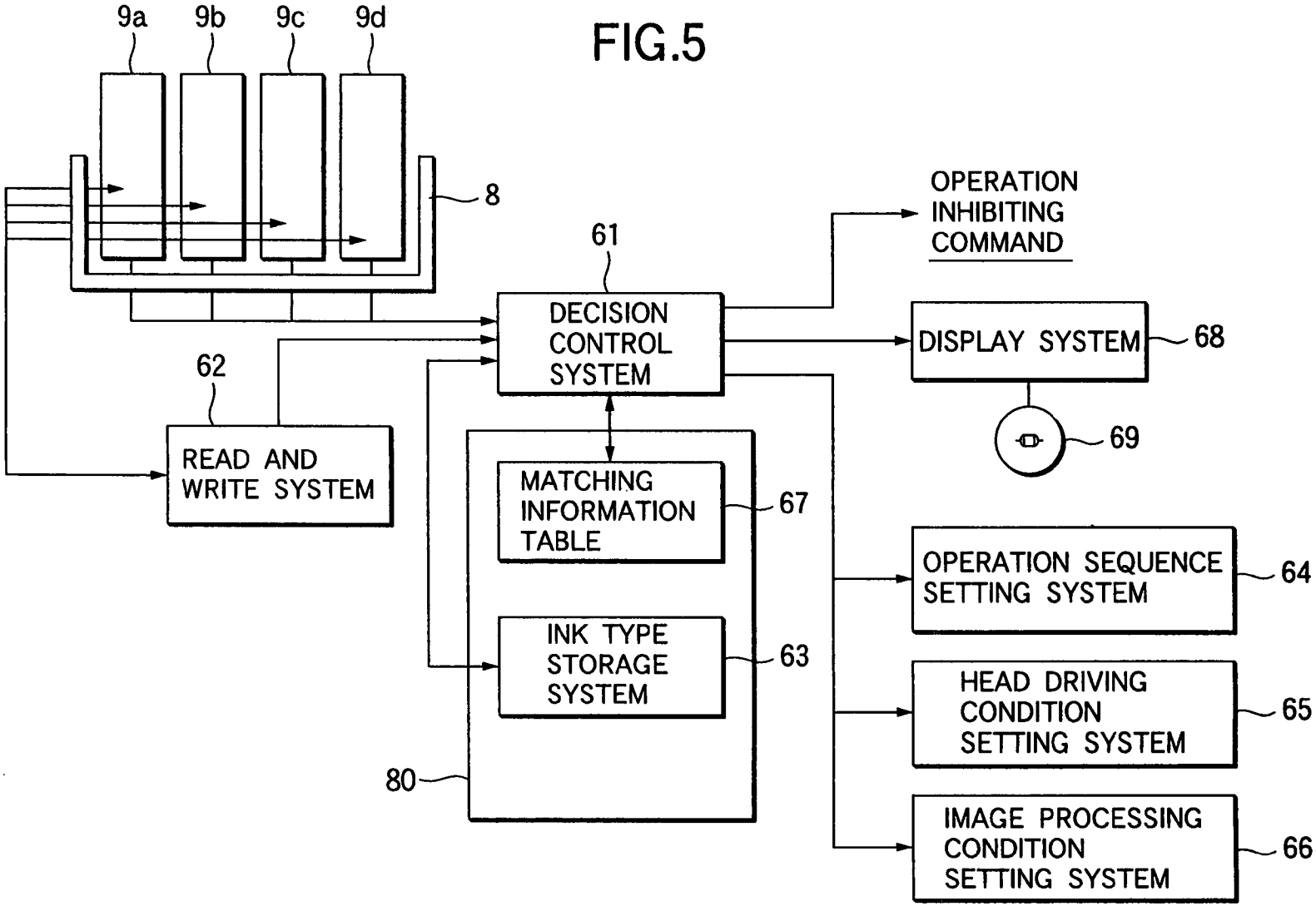
FIG. 5 is a block diagram showing the structure of a control circuit mounted on the ink jet type recording apparatus illustrated in FIG. 1.

FIG. 5 is a block diagram showing an example of a control system provided in the recording apparatus having the structure described above. The control system serves to set ink type information to the recording apparatus based on information sent from the attached ink cartridge. In FIG. 5, the reference numeral 8 denotes a cartridge holder and the reference numerals 9*a* to 9*d* denote ink cartridges.

The reference numeral 61 in FIG. 5 denotes a decision control system. The decision control system 61 receives information indicating whether or not each ink cartridge is attached to the cartridge holder 8. Moreover, a read and write system 62 is connected to the decision control system 61 so that information signals can be transferred therebetween in a bidirectional manner. The read and write system 62 receiving a command signal from the decision control system 61 acts as information reading means for reading ink type information and ink type setting permission information from the semiconductor storage system 27 mounted on each of the ink cartridges 9*a* to 9*d* attached to the cartridge holder 8.

Moreover, the read and write system 62 receiving the command signal from the decision control system 61 acts to carry out an operation for disabling the semiconductor storage system 27 mounted on each of the ink cartridges 9*a* to 9*d* to reread the ink type setting permission information or erasing the ink type setting permission information, which will be described later.

An ink type storage system 63 is connected to the decision control system 61 so that information signals can be transferred therebetween in a bidirectional manner. In the case in which the decision control system 61 decides that the ink type information is not set in the ink type storage system 63, it acts to write, to the ink type storage system 63, the ink type information obtained by the read and write system 62 on the conditions which will be described latter. In the embodiment, dye ink or pigment ink is used as the ink type.

The obtained ink type information (information indicative of either dye ink or pigment ink) is written to the ink type storage system 63 by the decision control system 61, and at the same time, a command for setting respective parameters suitable for the decided ink type is given by the decision control system 61 to an operation sequence setting system 64, a head driving condition setting system 65 and an image processing condition setting system 66.

In the operation sequence setting system 64, parameters for example, a periodic flashing interval, the amount of discharge of an ink drop, and the amount of suction during a cleaning operation, are set in an optimum state for each ink in accordance with the decided dye ink or pigment ink. In the head driving condition setting system 65, parameters, for example, a driving voltage and a driving frequency, are set in a suitable state in accordance with the decided dye ink or pigment ink. In the image processing condition setting system 66, parameters such as a look-up table are set in a suitable state in accordance with the decided dye ink or pigment ink.

Furthermore, a matching information table 67 is connected to the decision control system 61 so that information signals can be transferred therebetween in a bidirectional manner. Reference is made to the matching information table 67 when the ink type information has already been set to the ink type storage system 63 and it is decided that the ink type of a newly attached cartridge by cartridge exchange is coincident therewith.

More specifically, the matching information table 67 describes a compatibility of ink kinds whose ink types are coincident with each other and, for example, describes a matching information as to whether or not a print operation can be carried out without changing each parameter in the operation sequence setting system 64, the head driving condition setting system 65 and the image processing condition setting system 66. In the case in which the decision control system 61 constituting matching deciding means decides that there is a compatibility, a result of the decision that the print operation can be carried out is output.

In the case in which the decision control system 61 decides that the ink type read from the newly attached ink cartridge is not coincident with the ink type information which has already been set to the ink type storage system 63, or in the case in which the decision control system 61 decides that there is no compatibility even if the ink type information is coincident, an operation inhibiting command is output by the decision control system 61 for the recording apparatus. Consequently, the recording apparatus stops all the operations.

At the same time, the decision control system 61 causes a display system 68 to display error information. At this time, it is desirable that a buzzer 69 should be driven to aurally give an alarm.

Figure 6:
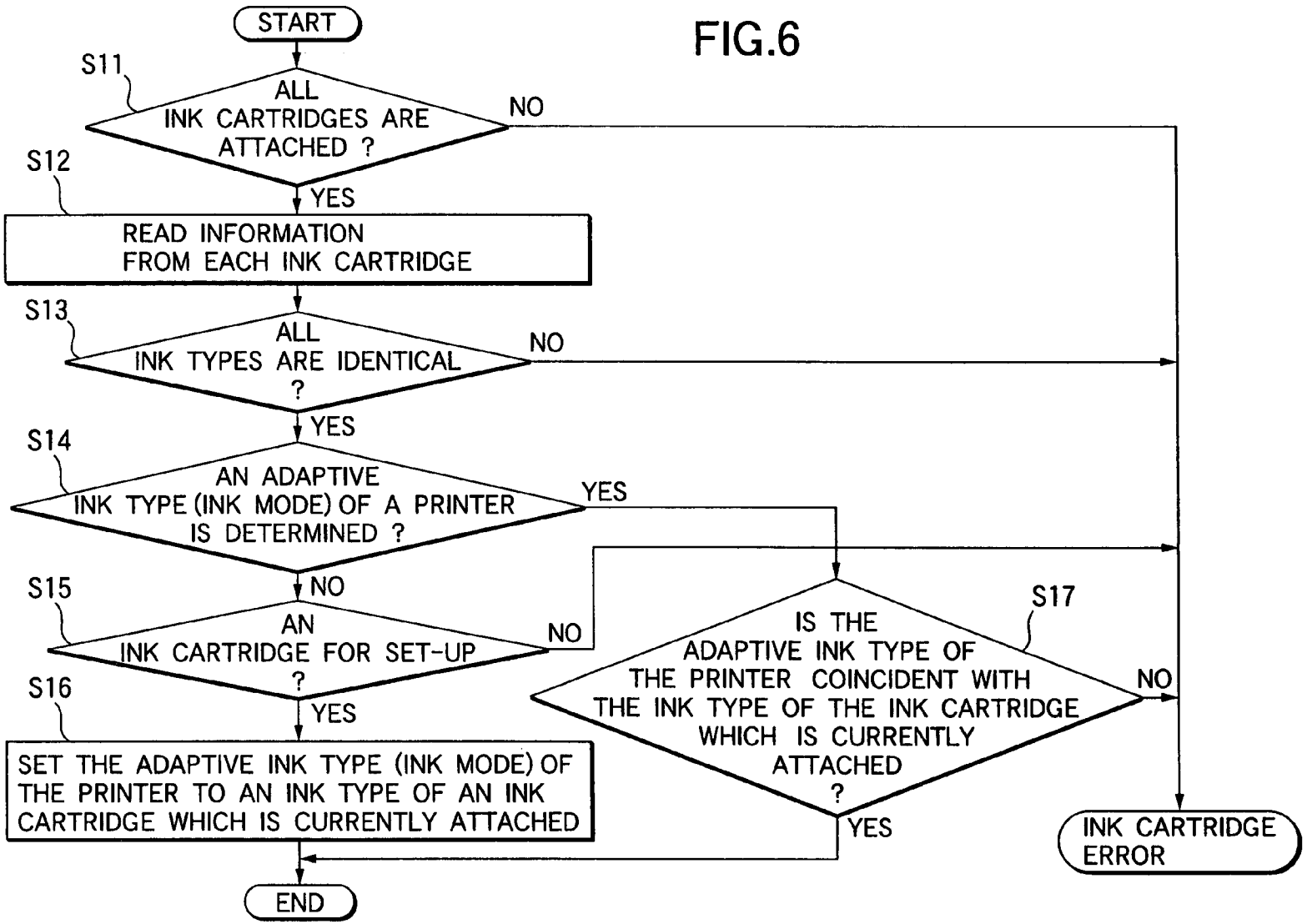
FIG. 6 is a flowchart showing a control routine to be carried out by the control circuit illustrated in FIG. 5.

FIG. 6 shows an example of an operation routine of the ink type information setting method to be carried out by the structure illustrated in FIG. 5. More specifically, at a step S11, it is decided whether or not all the ink cartridges are attached to the cartridge holder 8. The decision can be carried out by the decision control system 61 as described above. In the case in which all of the ink cartridges are not attached (No), error information is displayed on the display system 68. For example, an error message "All ink cartridges are not attached" is displayed on the display system 68 or a display device of a host computer 150 (see FIG. 7) connected to the recording apparatus 100.

In the case in which it is decided that all the ink cartridges are attached (Yes) at the step S11, information is read from each ink cartridge as shown in a step S12 subsequent thereto. As described above, the decision control system 61 sends a command signal to the read and write system 62, on the basis of which the read and write system 62 reads information such as an ink type from the semiconductor storage system mounted on each cartridge. Then, the information about the ink type thus read is transmitted to the decision control system 61.

As shown in a step S13, subsequently, the decision control system 61 decides whether or not all the ink types are identical. If it is decided that all the ink types are not identical (No), error information is displayed on the display system 68. For example, an error message "All ink cartridges are not identical in ink type" is displayed on the display system 68 or the display device of the host computer 150. Moreover, if it is decided that all the ink types are identical (Yes), the process proceeds to a step S14 where it is decided whether or not an adaptive ink type of the printer (recording apparatus) has been determined. This decision can be carried out by accessing the ink type storage system 63 by the decision control system 61.

If it is decided that the adaptive ink type of the recording apparatus has not yet determined (No), it is decided whether or not the ink cartridge attached to the cartridge holder is an ink cartridge for set-up. In the embodiment, if the attached ink cartridge is the ink cartridge for set-up, ink type setting permission information has been written to the semiconductor storage system mounted on the cartridge. Accordingly, the ink type setting permission information has already been fetched by the execution of the step S11.

If it is decided that the attached ink cartridge is not the ink cartridge for set-up (No), the same ink cartridge cannot be utilized and the error information is displayed on the display system 68. For example, an error message "Ink cartridge is not for set-up" is displayed on the display system 68 or the display device of the host computer 150. Moreover, if it is decided that the attached ink cartridge is the ink cartridge for set-up (Yes), the process proceeds to Step S16 where an operation for setting the adaptive ink type of the printer to the ink type of the ink cartridge which is currently attached is executed. More specifically, the decision control system 61 executes a setting operation for transmitting the ink type information to the ink type storage system 63 and writing the same ink type information thereto.

By the execution of the setting operation, the recording apparatus is set to exclusively handle either one of the dye ink and the pigment ink. At the same time, each parameter in the operation sequence setting system 64, the head driving condition setting system 65 and the image processing condition setting system 66 described above is also set, which is not shown in the operation sequence of FIG. 6. Consequently, the recording apparatus is dedicated to the dye ink or the pigment ink.

On the other hand, if it is decided that the adaptive ink type of the recording apparatus has already been determined (Yes) at the step S14, it is possible to recognize that the ink cartridge is to be newly exchanged. Then, the process proceeds to Step S17 where it is decided whether or not the adaptive ink type of the printer is coincident with the ink type of the ink cartridge which is currently attached. The decision control system 61 can carry out the decision by referring to the ink type information stored in the ink type storage system 63.

If it is decided that the ink types are coincident with each other (Yes), the newly attached cartridge is exactly used. Moreover, if it is decided that they are not coincident with each other (No), error information is displayed on the display system 68. For example, an error message "Ink cartridge of different ink mode is attached" is displayed on the display system 68 or the display device of the host computer 150.

While the description has been given such that it is decided whether the ink type information are coincident or not at the step S17, a compatibility is not always present even if it is decided that they are the same ink types. At the step S17, accordingly, it is desirable that an operation for deciding the presence of the compatibility should be executed by referring to the matching information table 67 as described above.

Moreover, in the case in which the operation for setting the ink type is executed at the step S16, it is desirable that the operation for disabling to reread the ink type setting permission information stored in the semiconductor storage system of the ink cartridge or erasing the ink type setting permission information should be carried out in response to a command sent from the recording apparatus, which is not shown in the operation routine of FIG. 6. By executing such an operation, it is possible to avoid erroneous ink type information setting operation which may be caused by attaching the used ink cartridge having the ink type setting permission information to another brand new recording apparatus.

On the other hand, in the ink cartridge according to the invention, the semiconductor storage system is designed to store at least the ink type information indicative of the ink type and the ink type setting permission information as described above. By this design, the recording apparatus having the structure described above can be caused to execute the operation for setting an ink type without errors. In this case, it is desirable that the ink cartridge having the ink type setting permission information should be packed and shipped together with the recording apparatus. Consequently, it can be guaranteed that a corresponding ink type can be reliably set to a brand new recording apparatus.

Moreover, it is preferable that the ink type information and the ink type setting permission information should be stored in the semiconductor storage system mounted on the cartridge as in the embodiment described above, while it is also possible to arrange a plurality of recessed and protruded portions in a part of the shell case of the cartridge as described above so that information indicative of an ink type can be obtained by the recording apparatus based on the arrangement configuration of the recessed and protruded portions. Furthermore, it is also possible to provide a bar code in a predetermined portion of the shell case of the cartridge, so that the recording apparatus can read the bar code to obtain information indicative of the ink type.

As is apparent from the above description, an ink jet type recording apparatus, employing a method of setting ink type information in accordance with the invention and utilizing an ink cartridge in accordance with the invention, can carry out setting to use an ink type of the ink cartridge, which is, for example, first attached to the recording apparatus. Accordingly, ink cartridges having different ink types can be reliably prevented from being utilized erroneously and the sound use of the recording apparatus of this kind can be guaranteed.

Figure 7:
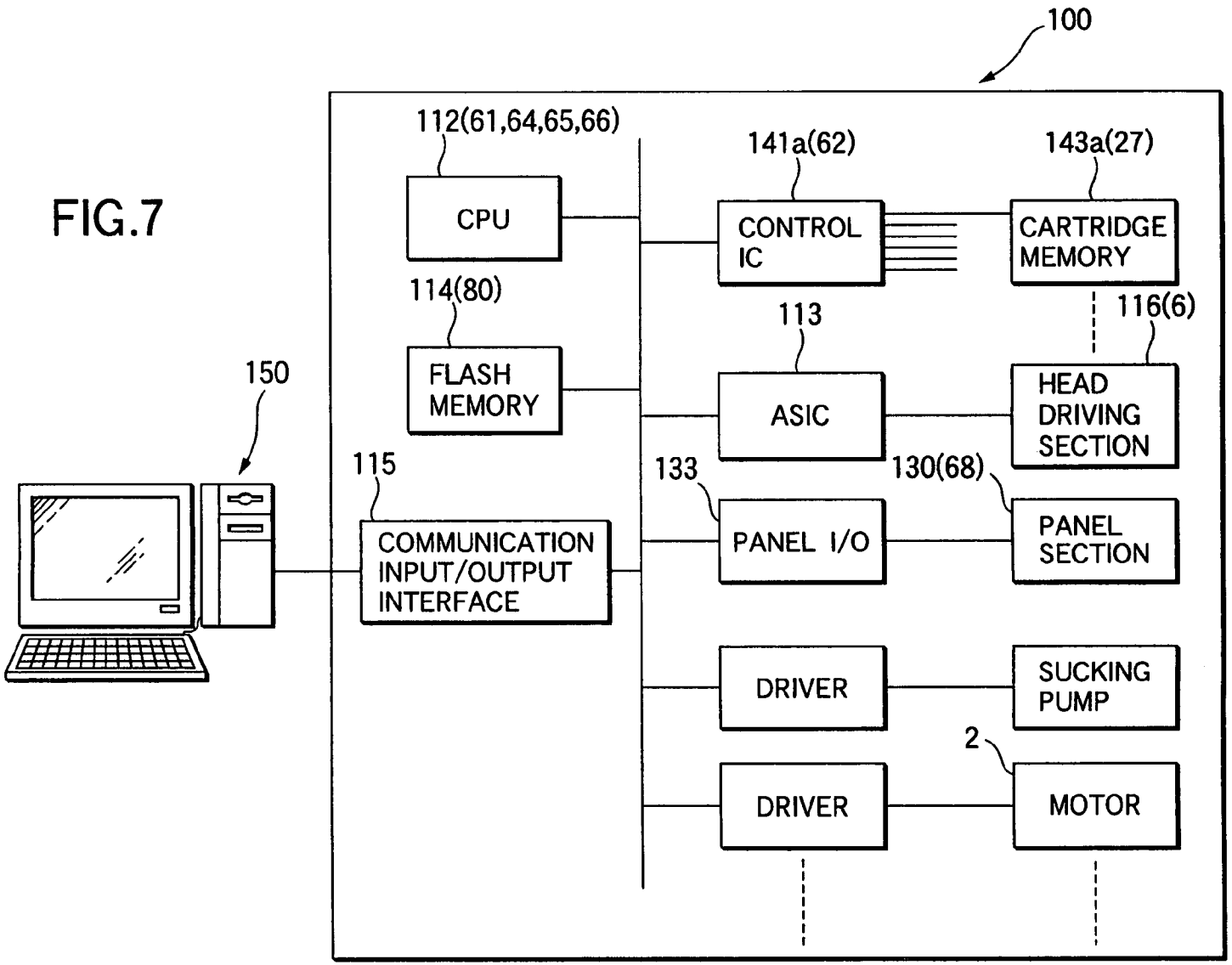
FIG. 7 is a block diagram showing another example of a control system in the recording apparatus according to the present invention.

FIG. 7 shows another example of a control system used in the recording apparatus 100. A CPU 112 functionally corresponds to the decision control system 61, operation sequence setting system 64, head driving condition setting system 65 and image processing condition setting system 66. A flash memory 114 functionally corresponds to the printer memory 80. An ink cartridge memory 143*a* functionally corresponds to the semiconductor storage system.

Figure 8:
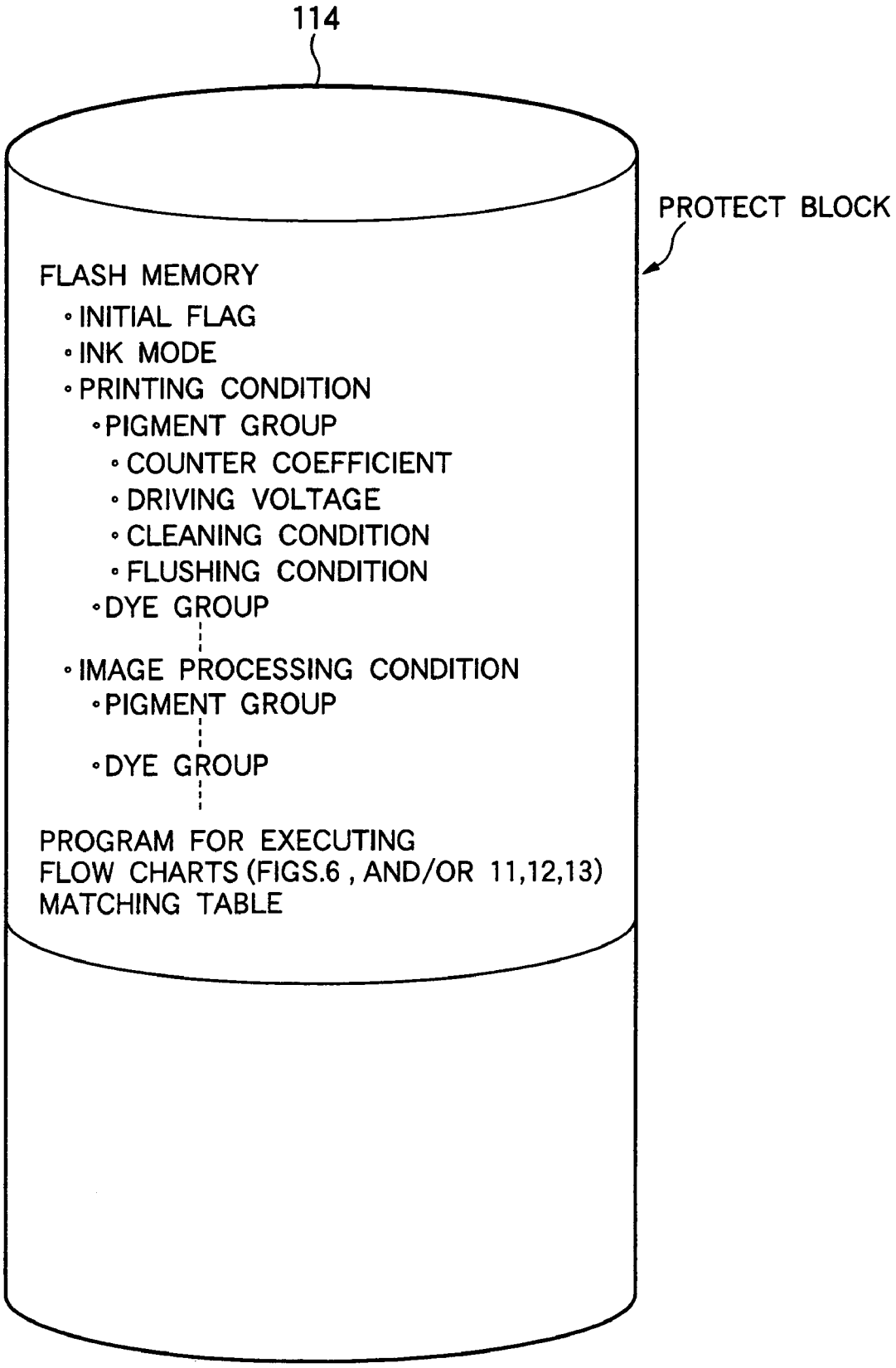
FIG. 8 is a schematic view mainly showing a memory map of a printer memory in the recording apparatus according to the present invention.

FIG. 8 shows a main part of a memory map of the flash memory 114 (the printer memory 80). The ink jet printer 100 according to the embodiment can use both of dye group ink and pigment group ink. Therefore, the flash memory 114 stores parameters for each ink group in order to execute proper control for ink of each ink group. More specifically, an initial flag indicating whether or not initial filling to fill an ink supply system, that is, the tube 36, with a predetermined ink is carried out, and an ink mode indicative of the type of ink which is currently used are stored.

Furthermore, print conditions, to be driving parameters different in ink type basis, are stored to correspond to each of the pigment group ink and the dye group ink. These data are stored in a protect block capable of inhibiting the write and erasure of data on a hardware basis. In the embodiment, the flash memory 114 constitutes supply ink storage means and print condition storage means. The print conditions include a counter coefficient, a driving voltage, a cleaning condition and a flashing condition. The counter coefficient is multiplied by a count value in an ASIC 113, and the consumed amount of each of the pigment group ink and the dye group ink is properly calculated from a unified count to be the number of dots based on the multiplication. Moreover, the pigment group ink and the dye group ink have ink characteristics, that is, viscosities, etc. which are different from each other. Therefore, the specific driving operation of the head 6 is varied even if the same operation such as ink discharge, cleaning or flashing is carried out.

The driving voltage, the cleaning condition and the flashing condition are stored for each ink group in an ink type basis. The CPU 112 reads such data to send an instruction to the ASIC 113, and a head driving section 116 executes a predetermined head driving operation in accordance with the instruction, thereby properly controlling ink of each group. For example, the driving voltage is data indicative of a pattern of an applied voltage generated in the head driving section 116, and the voltage is applied in different patterns as shown in FIG. 9.

More specifically, the driving voltage to be the print condition comprises a look-up table describing timer data. When the CPU 112 gives an instruction to the ASIC 113 by referring to the look-up data, the ASIC 113 converts the timer data and outputs applied voltage data to the head driving section 116.

The head driving section 116 generates a pulse, i.e. a periodic change of the voltage, based on the applied voltage data. The pulse mainly includes a rise pulse and a fall pulse. In the rise pulse, the applied voltage is raised and the piezoelectric element is driven so that the volume of the ink chamber is decreased. In the fall pulse, the applied voltage is dropped and the piezoelectric element is driven so that the volume of the ink chamber is increased. By regulating the widths of the pulses, the voltage generated by the head driving section 116 has substantially a trapezoidal shape shown in FIG. 9 and the discharge of the ink is controlled by such a voltage.

Figure 9:
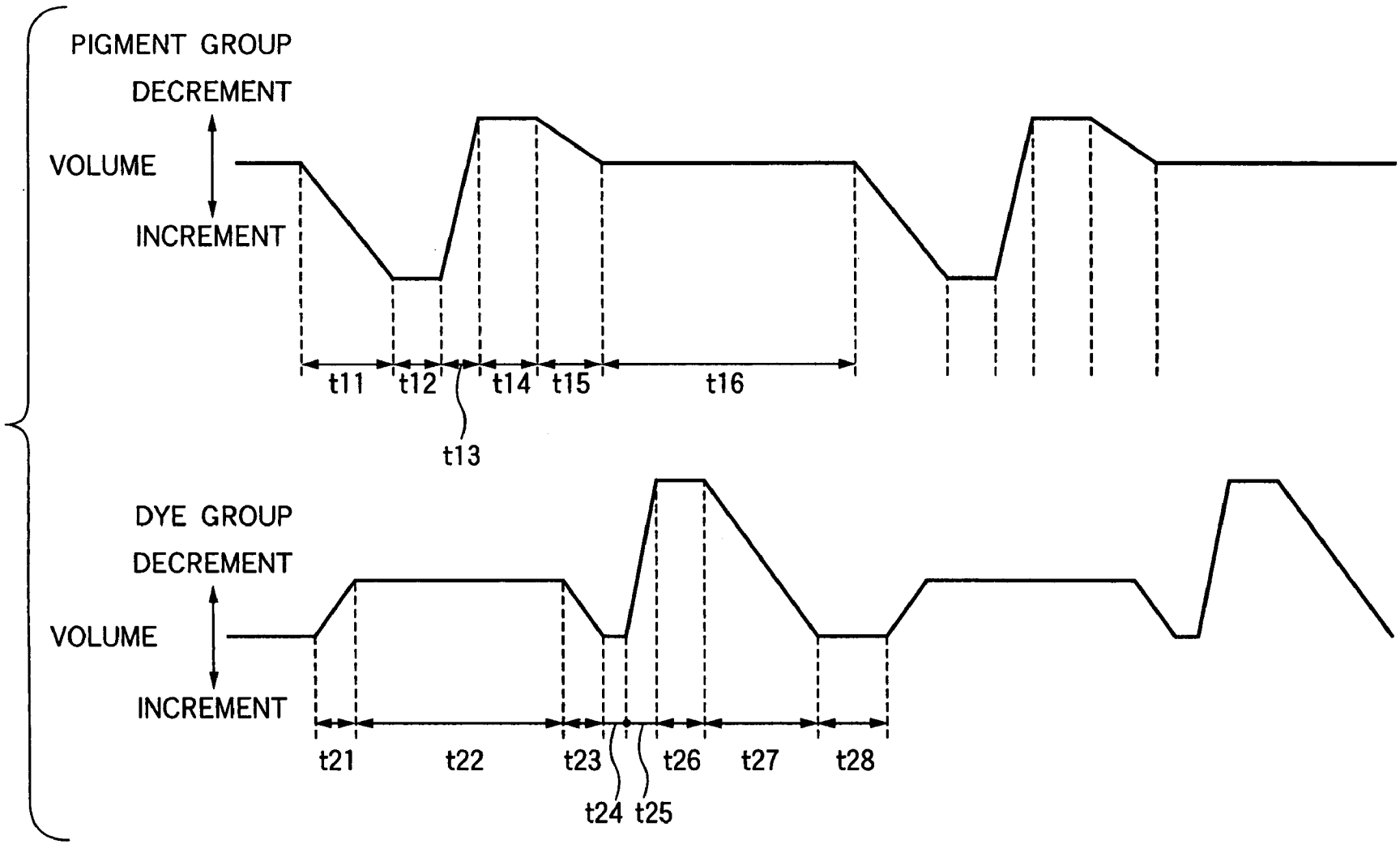
FIG. 9 is a timing chart showing voltage patterns generated by a head driving section and applied to a printing head.

The voltage pattern shown on the upper side of FIG. 9 is for the pigment group ink. For the pigment group ink, first of all, the fall pulse is input to increase the volume of the ink chamber at a time period t11. At a time period t12, then, the input of the pulse is stopped to hold the piezoelectric element, thereby stabilizing the state of the ink. At a time period t13, thereafter, the rise pulse is input to decrease the volume of the ink chamber, thereby discharging the ink. Furthermore, the input of the pulse is stopped to hold such a state at a time period t14, and the fall pulse is input to separate the discharge ink at a time period t15. At a time period t16, subsequently, the input of the pulse is stopped to hold such a state for a constant period and concurrently the carriage is driven to be ready for an ink discharge sequence for a next dot.

On the other hand, the voltage pattern shown on the lower side of FIG. 9 is for dye group ink. For the dye group ink, first of all, a rise pulse is input to decrease the volume of the ink chamber at a time period t21. At a time period t22, then, the input of the pulse is stopped to hold the piezoelectric element, thereby stabilizing the state of the ink. Thereafter, a fall pulse is input to increase the volume of the ink chamber at a time period t23 and such a state is held to stabilize the state of the ink at a time period t24. At a time period t25, the rise pulse is input again to decrease the volume of the ink chamber, thereby discharging the ink. Subsequently, such a state is held at a time period 26, the fall pulse is input to separate the discharge ink at a time period t27, and such a state is held at a time period t28. Thus, a discharge sequence for one dot is completed.

Thus, the pigment group ink and the dye group ink require different head driving patterns stemming from a difference in the ink characteristics. The driving voltage is stored in a group by group basis in order to carry out suitable control for each ink group, and reference is properly made thereto depending on the type of the ink. In addition to the driving voltage during the printing operation, the head driving section 116 can generate voltages for flashing. The head 6 can discharge the ink which is not related to the print through the voltage. When a constant time passes during the printing operation, reference is made to the flashing condition corresponding to the type of the ink and the head 6 can be caused to execute the predetermined ink discharge. A capping system 11 connected to a sucking pump (not shown) is provided under one of ends of the reciprocation of the head 6, and a negative pressure is applied to the head 6 delivered to the position of the capping system 11 to suck viscosity-increased ink thereto and to execute the initial filling process for the head 6.

The CPU 112 serves to apply the predetermined driving voltage to the sucking pump through a driver. Reference is made to the cleaning condition corresponding to the type of the ink according to a predetermined operation in an operation button provided on a panel section 130, and the head 6 can be subjected to a predetermined cleaning operation.

Furthermore, the initial filling process for the head 6 is executed after the ink cartridge is exchanged.

In addition, the image processing condition for each of the pigment group ink and the dye group ink is also stored in the protect block of the flash memory 114 (the printer memory 80).

Figure 10:
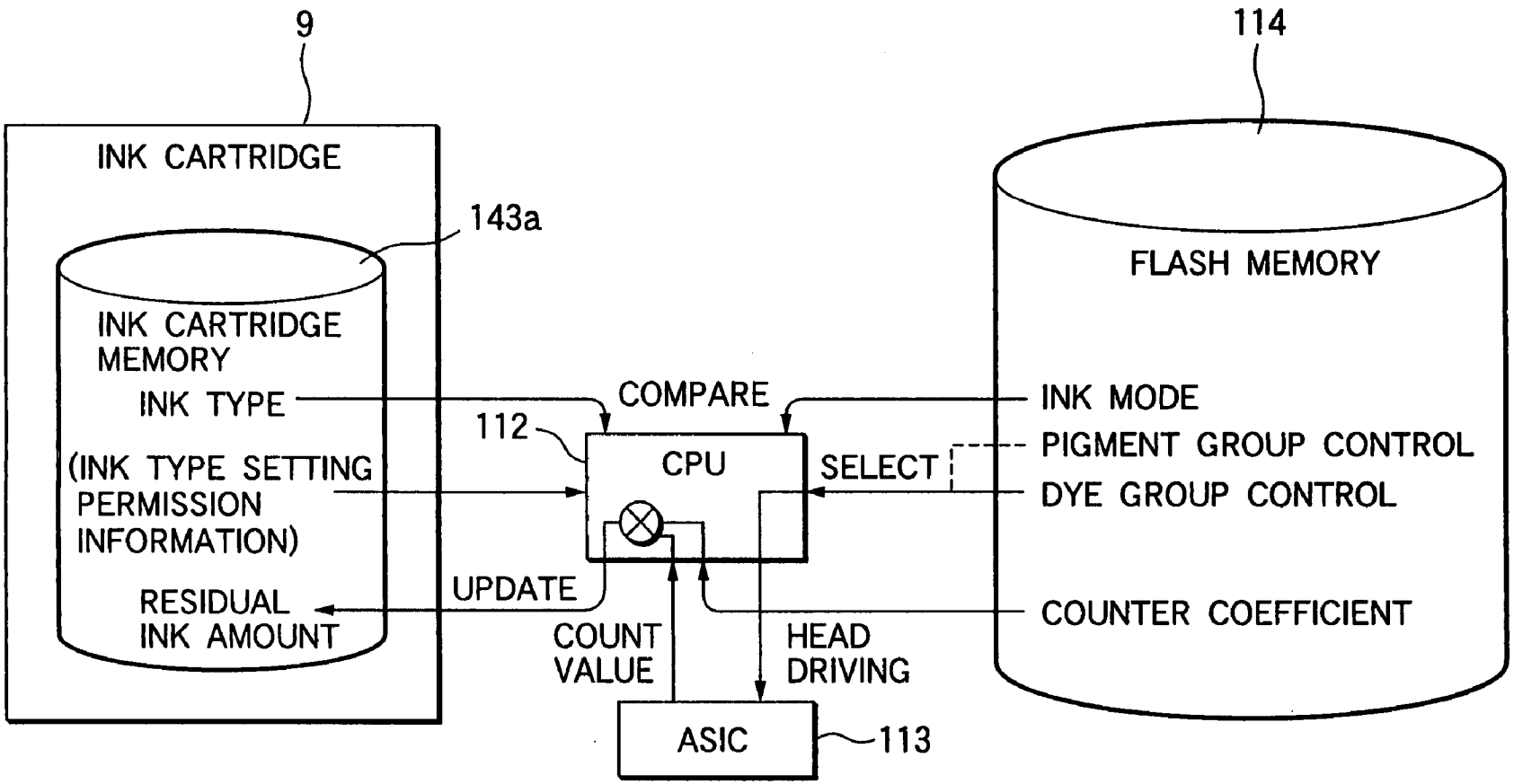
FIG. 10 is a schematic view showing an example of control to be executed by the control system according to the present invention.

FIG. 10 is a schematic diagram showing control to be carried out by the printer control device according to the invention in the structure described above. In the printer control device, main control is carried out by the CPU 112. In order to carry out a process corresponding to the type of an ink, the CPU 112 compares the type of ink which is stored in the cartridge memory 143*a* with an ink mode, i.e. the ink type information, stored in the flash memory 114 to execute printing in such a state that the type of the ink which is stored as the ink mode and is currently used, that is, which is filled in the ink supply system is coincident with the type of the ink filled in the ink cartridge 143.

By referring to the flash memory 114 to drive the head 6 on suitable conditions for the type of the ink to be coincident based on the comparison, moreover, parameters for pigment group control or dye group control are used corresponding to the type of the ink which is currently used, thereby driving the head 6. Furthermore, the number of dots counted by the ASIC 113 is multiplied by a counter coefficient corresponding to the type of the ink, thereby calculating the amount of the consumed ink. The amount of the consumed ink is subtracted from the amount of the residual ink amount stored in the cartridge memory 143*a*, to thereby update residual ink amount data. Consequently, the residual amount of each of the pigment group ink and the dye group ink is stored accurately. In the embodiment, the CPU 112, the ASIC 113, the head driving section 116 and the control IC 141*a* constitute head driving control means.

Figure 11:
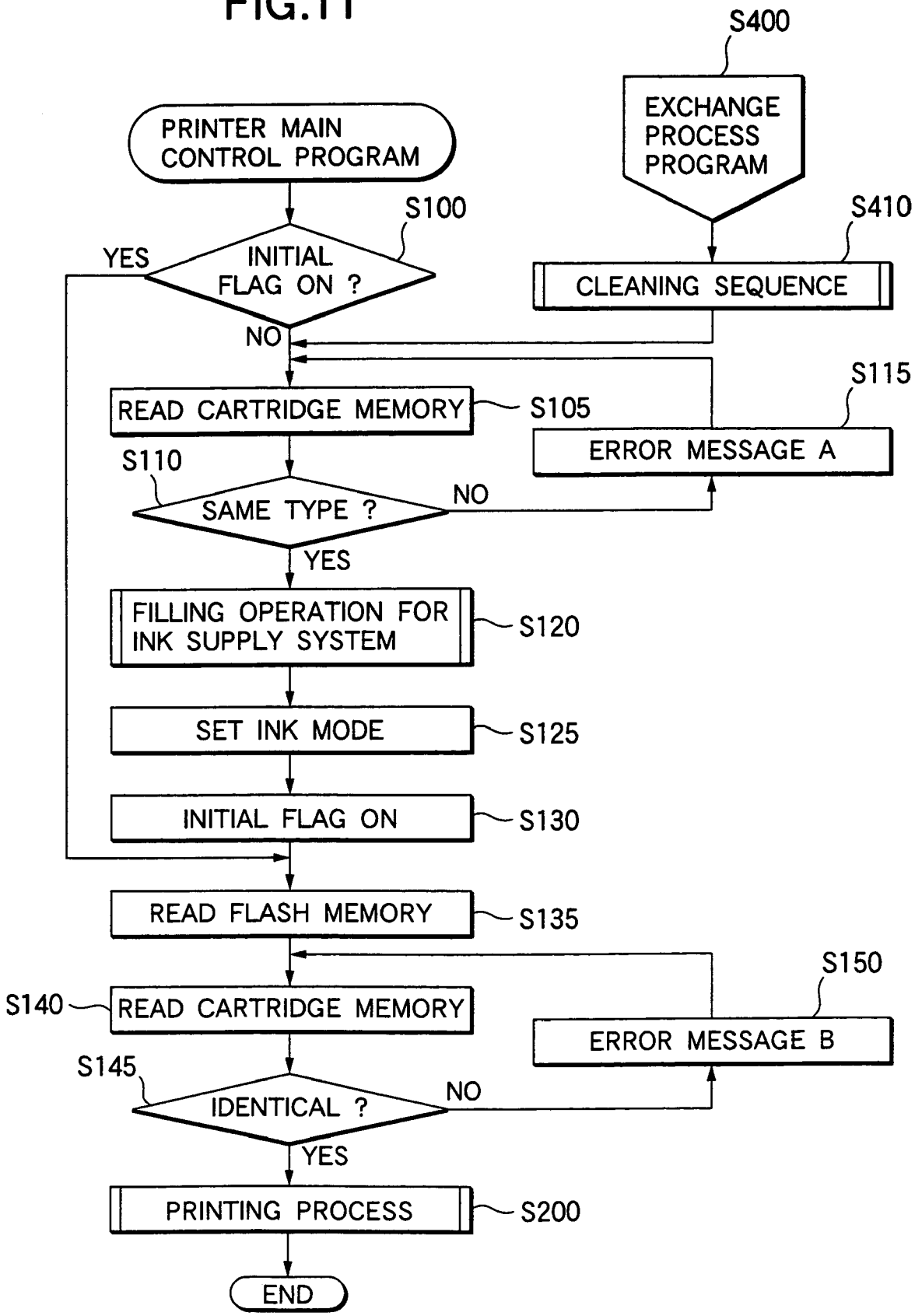
FIG. 11 is a flowchart executed by the control system according to the present invention.
Figure 12:
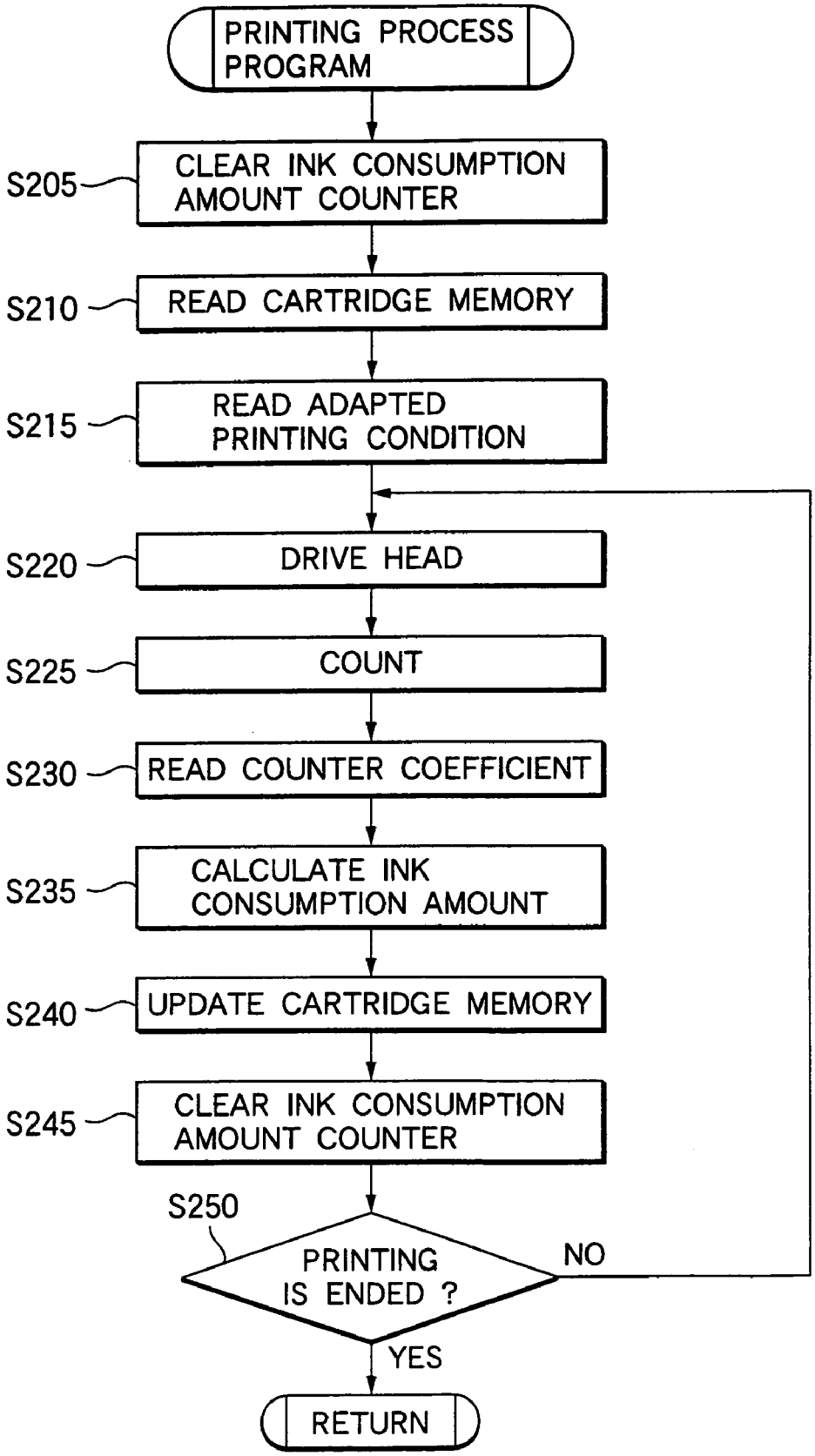
FIG. 12 is a flowchart executed by the control system according to the present invention.
Figure 13:
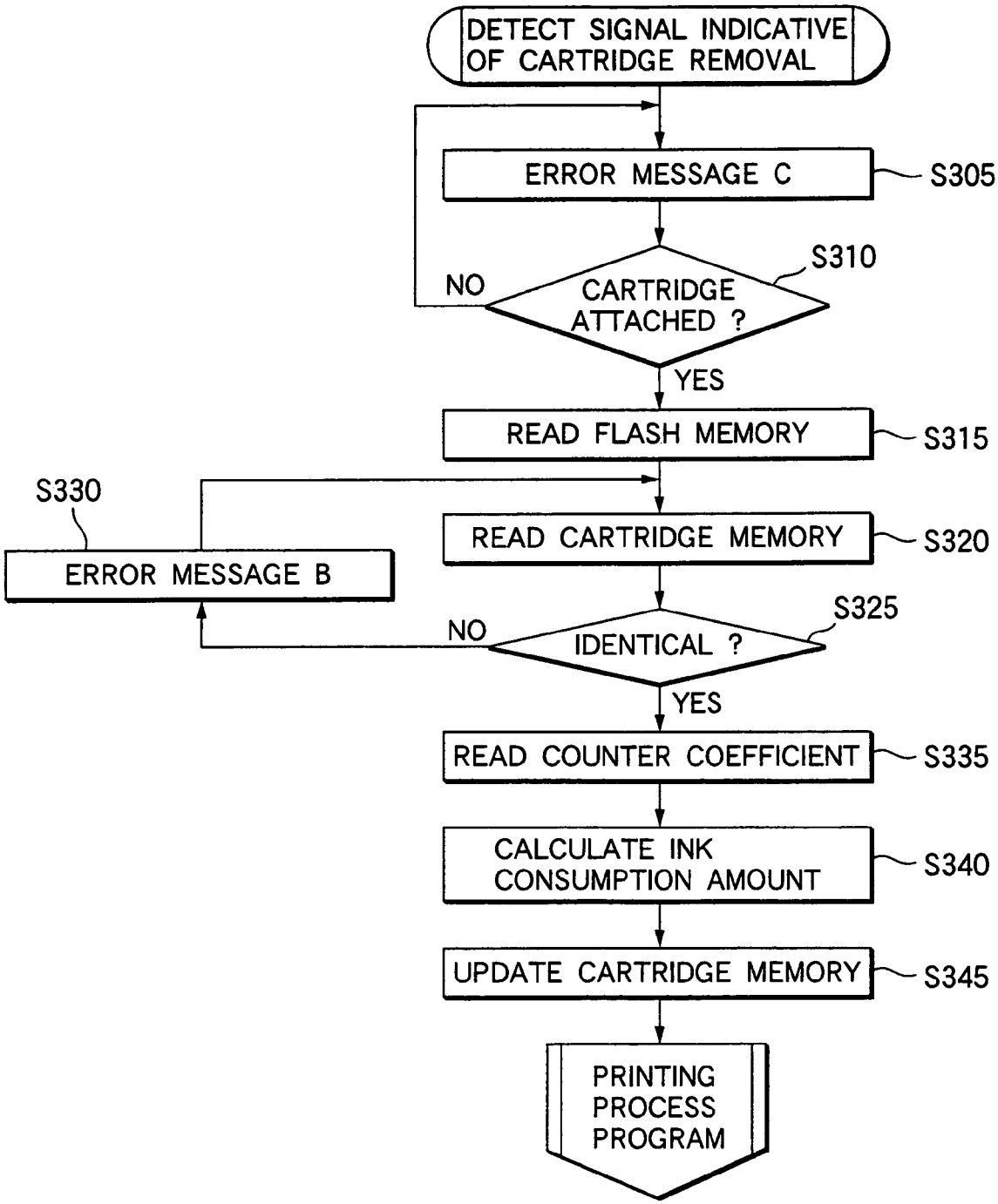
FIG. 13 is a flowchart executed by the control system according to the present invention.

FIGS. 11 to 13 show a flow chart showing another example of a process to be executed by the CPU 112 in the ink jet printer 100 including the control system described above. FIG. 11 is a process to be executed after booting the ink jet printer 100, and the CPU 112 refers to the flash memory 114, thereby deciding whether the initial flag is ON or not at a step S100. If it is not decided that the initial flag is ON at the step S100, it is assumed that the ink supply system such as the tube 36 is not filled with the ink and a process for filling the tube 36 with the ink is carried out.

Figure 14:
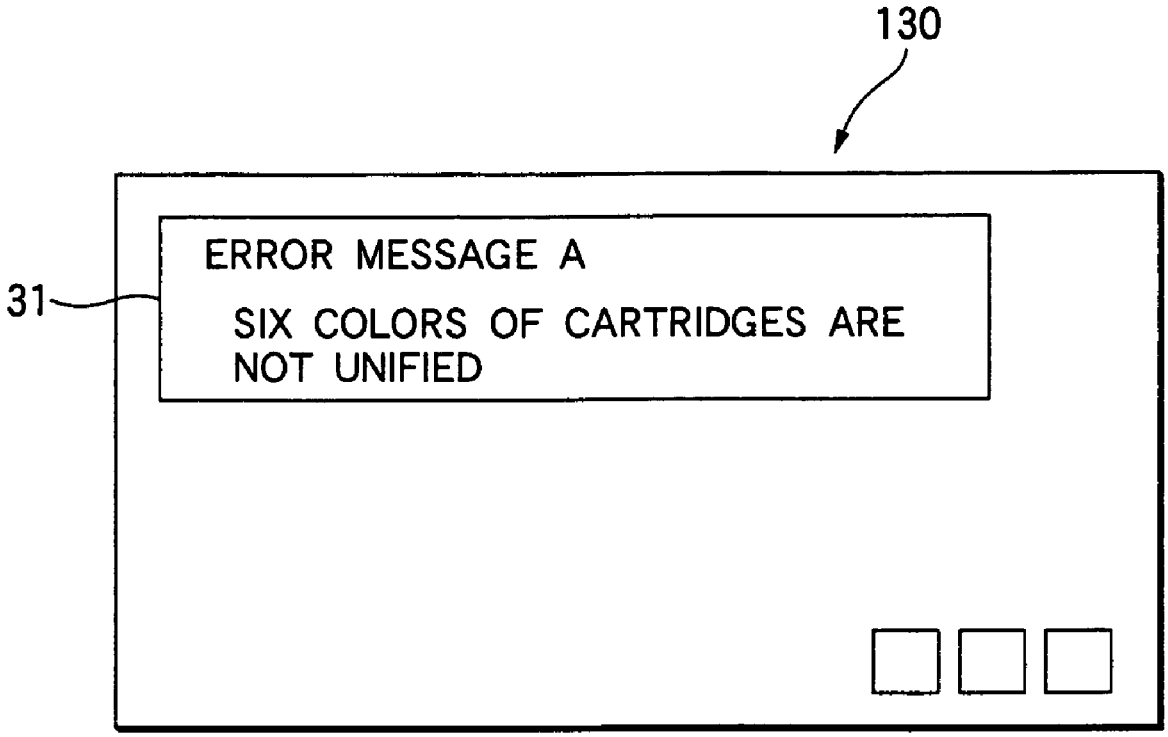
FIG. 14 shows an example of error message to be displayed.

At this time, the CPU 112 communicates with the control IC 141*a* to cause the control IC 141*a* to read the ink type stored in the cartridge memory 143*a*, thereby grasping the ink types of six colors (in case of FIG. 3) at a step S105. At a step S110, it is decided whether or not all of the ink types, i.e. the ink types of the six colors in case of FIG. 3, thus read are identical to each other. If it is not decided that the types are identical to each other, the panel section 130 (the display system 68) is controlled through a panel I/O 33 and the liquid crystal display portion of the panel section 130 is caused to display an error message shown in FIG. 14 at a step S115.

The error message A indicates "Six colors of cartridges are not unified" and promotes a user to exchange the erroneously inserted ink cartridge 143 with a proper ink cartridge 143 with the message displayed, and the processes of the steps 105 and the succeeding steps are repeated. When it is decided that the six colors have the same ink type at the step S110, a process of filling the ink supply system with the ink is executed at a step S120. The filling process is a special sequence for filling the ink supply system with the ink. After such a sequence is executed, the ink in the ink cartridge is filled in the ink supply system and also in the ink chambers of the head 6. Accordingly, when the piezoelectric element in the head 6 is driven in such a state, the ink is discharged from the nozzle opening 6*a* of the head 6.

In addition, prior to the step S100, the operation routine of the ink type information setting method as shown in FIG. 6 may be executed. Alternatively, the step S15 in the operation routine shown in FIG. 6 may be added between the step S110 and S120, so that if the attached ink cartridge is the ink cartridge for set-up, then the program advances to S120, and if the attached ink cartridge is not the ink cartridge for set-up, then an error message is displayed.

After the filling process, the flash memory 114 is accessed and the type of the filled ink is set to be an ink mode at a step S125. Furthermore, the flash memory 114 is accessed to turn ON the initial flag at a step S130. In the case in which such a filling process is carried out, and in the case in which it is decided that the initial flag is ON at the step S100, the flash memory 114 is accessed so that the ink mode is read at a step S135, and the control IC 141*a* is caused to read the ink type of the cartridge memory 143*a*, thereby grasping the type of the ink filled in the attached ink cartridge 143 at a step S140.

Figure 15:
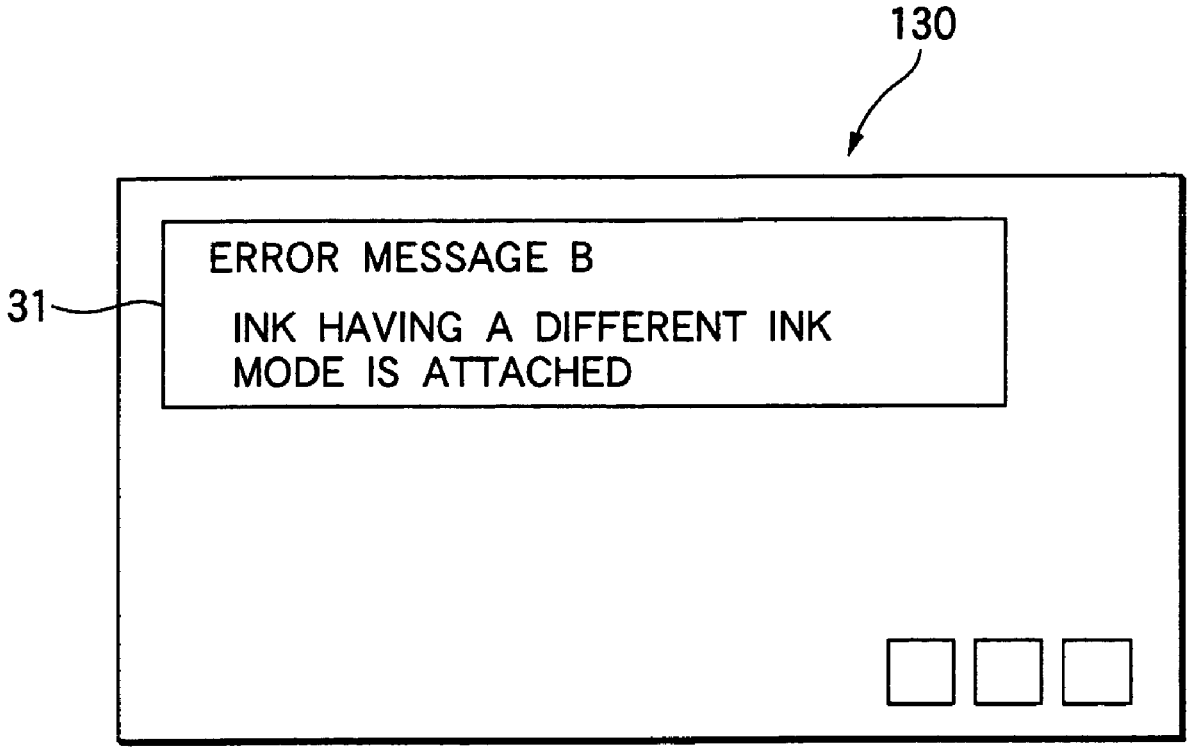
FIG. 15 shows an example of error message to be displayed.

At a step S145, then, it is decided whether or not the type of the ink filled in the ink cartridge 143 is coincident with the ink mode stored in the flash memory 114. When it is decided that both of them are coincident with each other at the step S145, a printing process is executed at a step S200. When it is not decided that both of them are coincident with each other at the step S145, the panel section 130 is controlled through the panel I/O 133 and an error message B shown in FIG. 15 is displayed on the liquid crystal display portion thereof at a step S150.

The error message B indicates "Ink having a different ink mode is attached" and promotes a user to exchange the erroneously inserted ink cartridge 143 with a proper ink cartridge 143 with the message displayed, and the processes of the step S140 and the succeeding steps are repeated. In the printing process of the step S200, an instruction for printing is given from the computer 150 and print data transmission is waited, and a process shown in FIG. 12 is carried out after the instruction for printing is given.

The ASIC 113 is accessed to clear an ink use amount counter in the ASIC 113 to "0" at a step S205, and the control IC 141*a* is caused to read the ink type of the cartridge memory 143*a* to grasp the type of the ink filled in the attached ink cartridge 143 at a step S210. At a step S215, then, the flash memory 114 is accessed so that print conditions adapted to the type of the ink are read. The suitable image processing condition is also read from the flash memory 114.

In a step S220 and subsequent steps, printing is executed while driving for predetermined lines is carried out based on the print data transmitted from the computer 150. At the step S220, a command is transmitted to the ASIC 113 by referring to the driving voltage of the print condition adapted to the type of the ink and the pulse is output to the head driving section 116, thereby driving the head 6. Thus, the head 6 is driven and is moved by means of the carriage to execute the printing operation, and counting is carried out in the ASIC 113 at a step S225.

When the printing operation for the predetermined lines is completed, the flash memory 114 is accessed so that a counter coefficient adapted to the type of the ink is read at a step 230 and the counter coefficient thus read is multiplied by a count value of the ASIC 113, thereby calculating the amount of the consumed ink at a step S235. At a step S240, a command is sent to the control IC 141*a* and the amount of the residual ink is updated such that the amount of the consumed ink calculated at the step S235 is subtracted from the amount of the residual ink which is stored in the cartridge memory 143*a*. At a step S245, the ASIC 13 is accessed to clear the ink consumed amount counter in the ASIC 13 to "0" again.

At a step S250, then, it is decided whether or not all the print data transmitted from the computer 150 are completely printed. The processes of the step S220 and the succeeding steps are repeated until it is decided that the printing operation is completed. In the embodiment, the head 6 is subjected to flashing in the one end position of reciprocation of the carriage. More specifically, after a constant time period passes during the printing operation, the head 6 is delivered to a flashing region and the flashing is executed while reading from the flash memory 114 the flashing condition adapted to the ink type read at the step S210. In the embodiment, moreover, in order to prevent the printing operation from being continuously executed when the ink cartridge 143 is removed, the processes of the steps S205 to S250 in FIG. 12 are suspended and a process shown in FIG. 13 is executed if a signal output from the control IC 141*a* at the time of removal of the ink cartridge 143 is detected.

Figure 16:
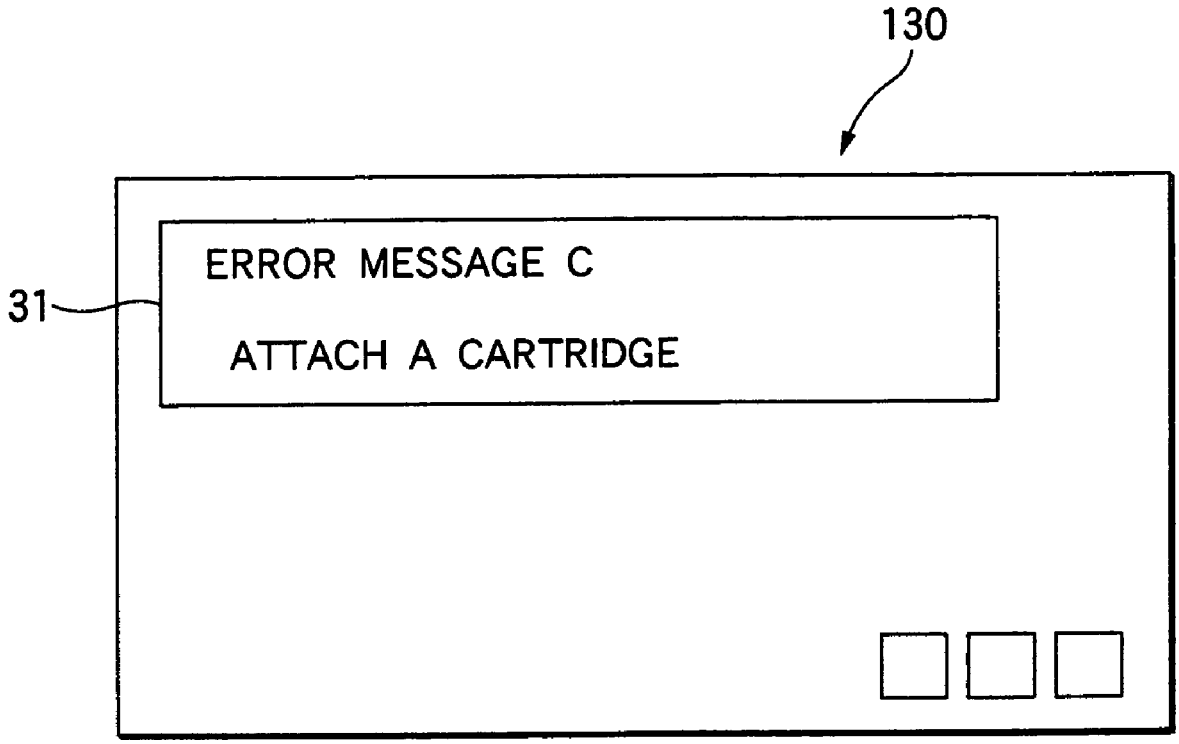
FIG. 16 shows an example of error message to be displayed.

When a signal indicating that the ink cartridge 143 is removed is detected, the panel section 130 is controlled through the panel I/O 133 and an error message C shown in FIG. 16 is displayed on the liquid crystal display portion of the panel section 130 at a step S305. The error message C indicates "Attach a cartridge" and demands the user to attach the ink cartridge 143 with the message displayed, and the processes of the step S305 and succeeding steps are repeated until a signal indicative of the attachment of the ink cartridge 143 is detected at a step S310. When the signal indicative of the attachment of the ink cartridge 143 is detected at the step S310, the flash memory 114 is accessed so that the ink mode is read at a step S315. The control IC 141*a* is caused to read the ink type of the cartridge memory 143*a*, thereby grasping the type of the ink filled in the attached ink cartridge 143 at a step S320.

At a step S325, then, it is decided whether or not the type of the ink filled in the ink cartridge 143 is coincident with the ink mode stored in the flash memory 114. When it is not decided that both of them are coincident with each other at the step S325, the panel section 130 is controlled through the panel I/O 133 at a step S330 and an error message B shown in FIG. 15 is displayed on the liquid crystal display portion of the panel section 130. When it is decided that both of them are coincident with each other at the Step S325, the flash memory 114 is accessed to read a counter coefficient adapted to the type of the ink at the step S325 and the counter coefficient thus read is multiplied by a count value held in the ASIC 113, thereby calculating the amount of the consumed ink at a step S340.

At a step S345, a command is sent to the control IC 141*a* and the amount of the residual ink is updated such that the amount of the consumed ink calculated at the step S340 is subtracted from the amount of the residual ink which is stored in the cartridge memory 143*a*. More specifically, upon decision as to whether or not the ink filled in the re-attached ink cartridge 143 is correct, the amount of the residual ink is updated based on a count value obtained by counting until the cartridge is removed. Accordingly, even if the ink cartridge 143 is removed during the printing operation, the amount of the residual ink becomes correct. Then, the printing process shown in FIG. 12 is returned.

In the embodiment, furthermore, both of the pigment group ink and the dye group ink can be used, and the types of the ink can be changed. In the exchange of the ink group, ink mixture of both groups causes various problems because proper coloring cannot be obtained on a printed medium and the driving pattern of the head 6 differs between the ink groups. Therefore, in the exchange of the ink group, it is also necessary to clean the ink supply system. The user or service man can carry out the process of exchanging ink by executing a predetermined pushing operation with the operation button of the panel section 130.

More specifically, when the predetermined pushing operation is carried out with the operation button of the panel section 130, a predetermined trigger corresponding to the operation is output. When the CPU 112 receives the trigger, an exchanging process shown in a step S400 of FIG. 11 is executed even if the printing operation is being executed. In the exchanging process, at a step S410, the user or the service man is advised to attach a cartridge containing a cleaning solution to the cartridge holder 42 with a predetermined guide message displayed on the liquid crystal display portion of the panel section 130. Thus, a cleaning sequence for the ink supply system is executed. After the cleaning process is carried out, the ink supply system of the ink jet printer 100 is set in a brand-new state, that is, similarly to the OFF state of the initial flag. Therefore, the processes of the step S105 and the succeeding steps are executed.

Furthermore, it is possible to execute a cleaning operation for cleaning the head 6 in addition to the cleaning process to be carried out in the change of the ink group. When a predetermined pushing operation is executed with the operation button of the panel section 130, a predetermined trigger corresponding to the operation is output. When the CPU 112 receives the trigger, the CPU 112 sends an instruction to the head driving section 116 through the ASIC 113. After the ink is discharged by a negative pressure, a wiping operation of a head surface is carried out by means of a wiping member formed of an elastic plate such as rubber.

Figure 17:
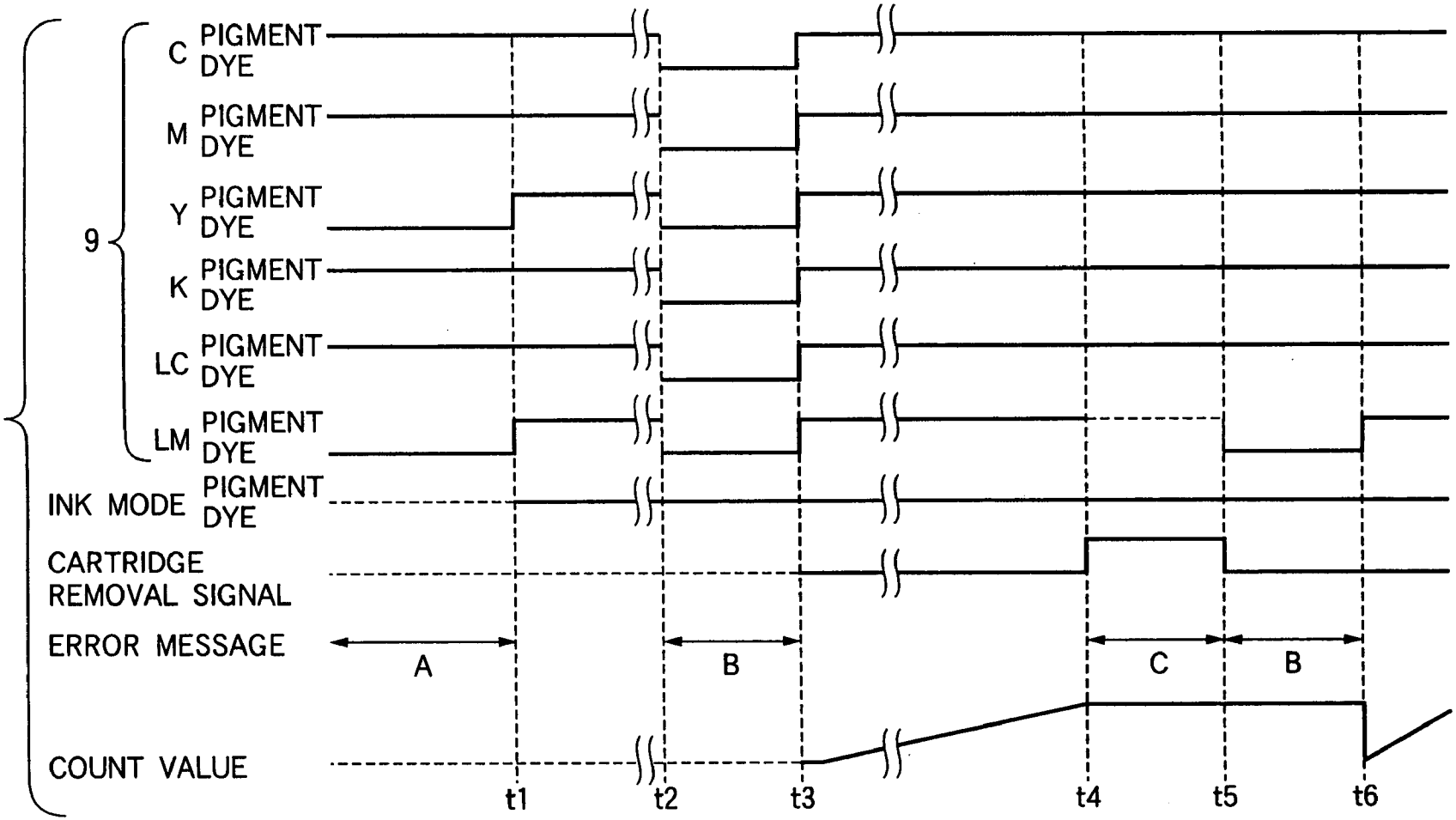
FIG. 17 is a timing chart for explaining operations according to the present invention.

Description will be given to an example of an operation to be carried out in accordance with the structure and processing flow described above in the embodiment. FIG. 17 is a timing chart showing the type of the ink filled in each ink cartridge 9, the contents of an ink mode stored in the flash memory 114, a signal output when the cartridge is removed, and a count value in the ASIC 113. In the example of the operation, it is assumed that pigment group ink is filled in each of ink cartridges for cyan (C), magenta (M), black (K) and light cyan (LC), and dye group ink is filled in each of ink cartridges for yellow (Y) and light magenta (LM) in an initial state.

In such a state, when the ink jet printer 100 is booted, the process shown in FIG. 11 is executed and it is decided whether the initial flag is ON or not at the step S100. Assuming that the initial flag is not ON, the ink type is read at the step S105 and the decision is carried out at the step S110. The ink cartridges containing pigment group ink therein and the ink cartridges containing the dye group ink therein are mixingly attached. Therefore, the error message A is displayed on the liquid crystal display portion of the panel section 116 at the step S115 through the decision of the step S110.

The user grasps that the types of the ink are mixed by visibly acknowledging the error message A, and removes the ink cartridges for yellow and light magenta and attaches ink cartridges for yellow and light magenta which are filled with the pigment group ink at the time t1. As a result, it is decided that the ink having the same type is filled in all of the ink cartridges at the step S110 and the initial filling for the ink supply system is executed at the step S120, the ink mode is set to be the pigment group ink to the flash memory 14 at the step S125, and the initial flag is turned ON at the step S130.

Even in the case in which the initial flag is ON, the type of the ink might be erroneously handled if ink cartridges are once removed when the ink jet printer 100 is carried, and are then attached again. For example, it is assumed that, after the initial filling is carried out as described above, ink cartridges 9 filled with the dye group ink are attached and then the ink jet printer 100 at the time t2.

In this case, after it is decided that the initial flag is ON at the step S100, the ink mode stored in the flash memory 114 is grasped to be the pigment group ink at the step S135, and the type of the ink which is stored in each cartridge memory 143*a* is read and is grasped to be the dye group ink at the step S140. As a result, it is decided that both of them are not coincident with each other at the step S145, and the error message B is displayed on the liquid crystal display portion of the panel section 130.

The user grasps that the type of the ink is erroneously handled by visually acknowledging the error message B, and reattaches the ink cartridge 9 filled with the pigment group ink at the time t3. As a result, it is decided that the ink mode is coincident with the ink type of the attached ink cartridges at the step S145, and the printing process at the step S200 is executed. When the printing process is started, the count value of the ink consumed amount counter in the ASIC 13 is cleared to "0" at the step S205 and it is grasped that the ink mode is set to the pigment group ink by referring to the flash memory 114 at the step S210.

The CPU 112 further reads the print condition adapted to the pigment group ink by referring to the flash memory 114 at the step S215 and the printing operation is carried out in the processes of the step S220 and the succeeding steps. At this time, the count value of the ASIC 13 is increased with the execution of the printing operation. When the printing operation is continuously carried out, it is ended soon. When the user removes the ink cartridge 9 (the light magenta in the embodiment) for some reason at the time t4 before the printing operation is ended, the control IC 141*a* outputs a signal indicating that the ink cartridge is removed.

As a result, the printing process executed by the CPU 112 is suspended and the flow of FIG. 13 is executed. More specifically, the error message C is displayed on the liquid crystal display portion of the panel section 130 to demand the user to visually acknowledge the error message C and to reattach the ink cartridge 9 at a step S305. When the user attaches the ink cartridge 9, the processes of the step S315 and succeeding steps are executed through the decision of a step S310. In the case in which an ink cartridge 9 filled with the dye group ink which is different from the other ink cartridges 9 is attached erroneously at a time t5, the error message B is further displayed by the processes of steps S315 to S330.

When the user visually acknowledges the error message to exchange the ink cartridge 9 for the proper cartridge filled with the pigment group ink at a time t6, the flash memory 114 is accessed so that a counter coefficient of the pigment group ink is read at a step S335 through the decision of the step S325. Then, a count value obtained by counting till the time t4 is multiplied by the count coefficient to calculate the amount of the consumed ink at a step S340, and the cartridge memory 143*a* is updated through the control IC 141*a* at a step S345. More specifically, even if the ink cartridge 9 is removed during the printing operation, the count value obtained up to that time is held and the amount of the residual ink is updated when the proper ink cartridge 9 is attached again. Therefore, the amount of the residual ink which is stored in the cartridge memory 143*a* can be obtained properly.

In the invention, thus, the type of ink and the amount of the residual ink are stored in a nonvolatile memory mounted on the ink cartridge. When ink is supplied to an ink supply system, the type of the ink is stored in the printer memory. When printing is to be executed, the type of the ink which is stored in the printer memory is compared with the type of the ink which is stored in the nonvolatile ink cartridge memory. As a result, when both of the types are coincident with each other, suitable print control for the type of the ink can be executed. Mixing of the ink types can be surely prevented. Moreover, since the amount of the consumed ink is calculated corresponding to the driving of the head so that the amount of the residual ink is updated, the amount of the residual ink can properly be decided.

What is claimed is:

1. An ink cartridge holding at least ink type information indicative of an ink type of accumulated ink and ink type setting permission information for permitting a recording apparatus to set an ink type by utilizing the ink type information, wherein the ink type information and the ink type setting permission information are provided to the recording apparatus in a state of attachment to the recording apparatus, and an ink type to be used in the recording apparatus can be set on a condition that the ink type setting permission information is obtained in the recording apparatus;

wherein the ink type information and the ink type setting permission information are stored in a semiconductor storage system mounted on the ink cartridge, and the ink type information and the ink type setting permission information can be provided to the recording apparatus in a state of attachment to the recording apparatus and wherein the ink type setting permission information stored in the semiconductor storage system can bring a state in which the ink type setting permission information cannot be reread or the ink type setting permission information can be erased upon receipt of a command from the recording apparatus.

2. An ink cartridge holding at least ink type information indicative of an ink type of accumulated ink and ink type setting permission information for permitting a recording apparatus to set an ink type by utilizing the ink type information, wherein the ink type information and the ink type setting permission information are provided to the recording apparatus in a state of attachment to the recording apparatus, and an ink type to be used in the recording apparatus can be set on a condition that the ink type setting permission information is obtained in the recording apparatus and wherein the ink type setting permission information is capable of bringing a state in which the ink type setting permission information cannot be reread upon receiving a command from the recording apparatus.

3. An ink cartridge holding at least ink type information indicative of an ink type of accumulated ink and ink type setting permission information for permitting a recording apparatus to set an ink type by utilizing the ink type information, wherein the ink type information and the ink type setting permission information are provided to the recording apparatus in a state of attachment to the recording apparatus, and an ink type to be used in the recording apparatus can be set on a condition that the ink type setting permission information is obtained in the recording apparatus and wherein the ink type setting permission information is capable of bringing a state in which the ink type setting permission information can be erased upon receiving a command from the recording apparatus.

* * * * *